US012780592B2

(12) United States Patent
Cui et al.

(10) Patent No.: US 12,780,592 B2
(45) Date of Patent: Nov. 3, 2026

(54) COMPACT INTEGRATED HIGH-SPEED FOLDING MACHINE AND LINKAGE PRODUCTION METHOD

(71) Applicant: ALLMED MEDICAL PRODUCTS CO., LTD, Yichang (CN)

(72) Inventors: Jinhai Cui, Yichang (CN); Daobing Zhang, Yichang (CN); Fulin Liu, Yichang (CN); Zilong Yang, Yichang (CN)

(73) Assignee: ALLMED MEDICAL PRODUCTS CO., LTD (CN)

( * ) Notice: Subject to any disclaimer, the term of this patent is extended or adjusted under 35 U.S.C. 154(b) by 264 days.

(21) Appl. No.: 18/720,126

(22) PCT Filed: Dec. 14, 2022

(86) PCT No.: PCT/CN2022/139008
§ 371 (c)(1),
(2) Date: Jun. 14, 2024

(87) PCT Pub. No.: WO2023/116530
PCT Pub. Date: Jun. 29, 2023

(65) Prior Publication Data

US 2025/0051127 A1 Feb. 13, 2025

(30) Foreign Application Priority Data

Dec. 22, 2021 (CN) ..... 202111580419.5

(51) Int. Cl.
*B65H 45/24* (2006.01)
*B65H 45/16* (2006.01)
*B65H 45/28* (2006.01)

(52) U.S. Cl.
CPC ..... *B65H 45/24* (2013.01); *B65H 45/162* (2013.01); *B65H 45/28* (2013.01)

(58) Field of Classification Search
CPC .... A61F 13/15747; B65H 2301/42146; B65H 2701/1924; B65H 31/06; B65H 35/08;
(Continued)

(56) References Cited

U.S. PATENT DOCUMENTS 3,540,723 A * 11/1970 Hanz-Bernhard ..... B41F 13/56 493/360
3,640,522 A * 2/1972 Oelmann ..... B65H 45/168 493/353

(Continued)

FOREIGN PATENT DOCUMENTS

CN 102514977 A 6/2012
CN 210525278 U 5/2020

(Continued)

OTHER PUBLICATIONS

International Search Report of PCT/CN2022/139008.
Written Opinion of PCT/CN2022/139008.

*Primary Examiner* — Himchan Song

(57) ABSTRACT

The present disclosure discloses a compact integrated high-speed folding machine and a linkage production method, the machine includes a big rotary drum (1), a splitting mechanism (2), an inserting-folding mechanism (3), an adsorbing-transferring mechanism (4), a unwinding mechanism (5) and a hooking-folding mechanism (6); wherein a bottom blade roller (21) of the splitting mechanism (2) and a middle inserting roller (33) of the inserting-folding mechanism (3) are respectively positioned at the upper and lower ends of the vertical center line of the big rotary drum (1), the adsorbing-transferring mechanism (4) and the unwinding mechanism (5) are respectively positioned on both sides of the vertical center line, and the hooking-folding mechanism (6) is arranged on one side of the adsorbing-transferring mechanism (4); the gauze sheet can be folded many times in (Continued)

the axis direction on the big rotary drum (1), then continuously transferred to the hooking-folding mechanism (6).

18 Claims, 14 Drawing Sheets

(58) Field of Classification Search
CPC ..... B65H 45/162; B65H 45/18; B65H 45/24; B65H 45/28; B65H 45/30
See application file for complete search history.

(56) References Cited

U.S. PATENT DOCUMENTS 3,689,061 A * 9/1972 Nystrand ..... B65H 45/16 493/429
4,349,185 A * 9/1982 Small ..... B65H 45/12 270/32
4,569,672 A * 2/1986 Marion ..... B65H 45/28 493/359
5,904,277 A * 5/1999 Niedermeyer ..... A41H 42/00 223/1
5,906,061 A * 5/1999 Adler ..... D06F 89/00 38/143
6,258,017 B1 * 7/2001 Singh ..... B65H 45/22 493/442
6,440,053 B1 * 8/2002 Niedermeyer ..... B65H 45/28 493/422
7,758,486 B2 * 7/2010 Ochsenbauer ..... B31F 1/0019 493/426
2002/0052282 A1 * 5/2002 St. Germain ..... B65H 45/165 493/419
2004/0112783 A1 * 6/2004 Mukai ..... D21H 21/18 206/494
2005/0070419 A1 * 3/2005 Haasl ..... B65H 29/6618 493/435
2009/0241793 A1 * 10/2009 DiGenova ..... B41F 33/0009 101/483

FOREIGN PATENT DOCUMENTS

CN 111616456 A 9/2020
CN 216638417 A 5/2022

* cited by examiner

COMPACT INTEGRATED HIGH-SPEED FOLDING MACHINE AND LINKAGE PRODUCTION METHOD

CROSS-REFERENCE TO RELATED APPLICATIONS

This Application is a national stage application of PCT/CN2022/139008. This application claims priorities from PCT Application No. PCT/CN2022/139008, filed Dec. 14, 2022, and from the Chinese patent application 202111580419.5 filed Dec. 22, 2021, the content of which are incorporated herein in the entirety by reference.

TECHNICAL FIELD

The present disclosure belongs to the technical field of medical supplies production facilities, and relates to a compact integrated high-speed folding machine and a linkage production method.

BACKGROUND

Among medical supplies, there is a kind of surgical gauze including gauze with and without a barium sulfate thread, as well as adopting different kinds of gauze, such as thin gauze and dense gauze. At present, a commonly-adopted preparation method includes the steps of firstly cutting out a gauze sheet, then folding the gauze sheet, next pressing a barium sulfate thread to adhere to the gauze sheet, and then manually folding the barium sulfate thread and sewing it in a layer of the folded gauze sheet. In the process of making the barium sulfate thread adhere to the gauze, a thread releasing mechanism is used to draw a barium sulfate thread, so that the barium sulfate thread is pressed on the gauze sheet by a pressure device when it passes through multiple gauze sheets. Thus, as the barium sulfate thread is still connected to each other after having attached to multiple gauze sheet, it is necessary to use a cutting device to cut the barium sulfate thread. Since there is a section of the barium sulfate thread connected between every two gauze sheets, as well as a certain distance therebetween, cutting the barium sulfate thread causes great waste; secondly, a gauze sheet with and without a barium sulfate thread cannot be synchronously produced on an identical machine.

SUMMARY

The technical problem to be solved by the present disclosure is to provide a compact integrated high-speed folding machine and a linkage production method, so as to make it possible that: the splitting mechanism, the inserting-folding mechanism and the adsorbing-transferring mechanism are arranged outside the big rotary drum, and the bottom blade roller of the splitting mechanism and the middle inserting roller of the inserting-folding mechanism are respectively positioned at the upper and lower ends of the vertical center line of the big rotary drum; the adsorbing-transferring mechanism and the unwinding mechanism are respectively positioned on both sides of the vertical center line, and the hooking-folding mechanism is arranged on one side of the adsorbing-transferring mechanism; the gauze sheet can be folded many times in the axis direction on the big rotary drum, then continuously transferred to the hooking-folding mechanism, on which the gauze sheet is folded many times in the radial direction, synchronously producing a gauze sheet with and without a barium sulfate thread.

In order to solve the above technical problem, the technical scheme adopted in the present disclosure is as follows: a compact integrated high-speed folding machine, comprising a big rotary drum, a splitting mechanism, an inserting-folding mechanism, an adsorbing-transferring mechanism, a unwinding mechanism and a hooking-folding mechanism; wherein a bottom blade roller of the splitting mechanism and a middle inserting roller of the inserting-folding mechanism are respectively positioned at the upper and lower ends of the vertical center line of the big rotary drum, the adsorbing-transferring mechanism and the unwinding mechanism are respectively positioned on both sides of the vertical center line, and the hooking-folding mechanism is arranged on one side of the adsorbing-transferring mechanism; the splitting mechanism is splitting a gauze sheet, while adsorbing, drawing and transferring another gauze sheet.

A heating roller is further arranged between the unwinding mechanism and the splitting mechanism, and a Barium sulfate thread guiding groove is arranged in the front of the heating roller; the heating roller has a segmented heating structure.

Folding-clamping seams are disposed on a drum wall of the big rotary drum, adsorption holes arranged on both sides of one folding-clamping seam between every two folding-clamping seams lead to a negative pressure cavity of the big rotary drum, and a through hole arranged on a hollow shaft that passes through the drum body leads to the negative pressure cavity; a folding-clamping blade of the folding-clamping mechanism is positioned and configured to swing inside the folding-clamping seam, and a shifting fork lever of a shifting fork mechanism is positioned and configured to turn over at the upper part of the folding-clamping seam.

Two ends of the hollow shaft are further respectively matched with a stationary track disk and a mobile track disk, and the folding-clamping mechanism and the shifting fork mechanism fit with the stationary track disk and the mobile track disk.

The splitting mechanism comprises a cutting blade roller matched with the bottom blade roller, and a traction roller also arranged at the upper parts of the bottom blade roller and the cutting blade roller; a bottom blade and a cutting blade are respectively disposed on the cutting blade roller and the bottom blade roller, the bottom blade and the cutting blade hit against each other at a cutting point, and the bottom blade is recessed in the bottom blade roller, while the cutting blade extends out of the cutting blade roller.

The inserting-folding mechanism comprises a second-time inserting roller, a pressure roller and a middle inserting roller, the second-time inserting roller and the pressure roller are respectively positioned at the upper and lower sides of the horizontal centerline of the big rotary drum; a second-time inserting blade of the second-time inserting roller and a middle inserting blade of the middle inserting roller correspond to a folding-clamping seam on the big rotary drum, and a triple pressure head on the pressure roller is rotationally in contact with a drum wall.

The adsorbing-transferring mechanism comprises a plurality of adsorption valves that are distributed in a fan-shaped manner on a negative pressure shaft and a hooking-pulling groove arranged between the adsorption valves; a plurality of adsorbing-transferring holes arranged on the arc-shaped end face of the adsorption valve lead to the negative pressure shaft, and groove holes are arranged on two sides of the adsorbing-transferring hole.

A barium sulfate thread drawing hook is arranged on the upper part of the unwinding mechanism, and an edge-folding mechanism is arranged between the barium sulfate thread drawing hook and the heating roller; one side or two sides in the axial direction of a transition roller of the edge-folding mechanism are provided with an edge-pressing lever in contact with it, and one side of the transition roller is further provided with a shaping wheel; the barium sulfate thread guiding groove is positioned between the shaping wheel and the heating roller.

The hooking-folding mechanism comprises a longitudinal sliding stand, a hooking-folding plate and a pushing plate that are connected to the longitudinal sliding stand, a horizontal sliding stand, and an inserting-folding plate connected to the horizontal sliding stand, the hook-folding plate is positioned in a gap between a accommodating groove and a guiding plate and slides therebetween, the pushing plate is positioned in the accommodating groove and slides therein, and the inserting-folding plate passes through a folding-seam opening on the guiding plate and the accommodating groove; a buffer positioned on one side of the guiding plate is connected to a sliding plate, and the buffer passes through the guiding plate and penetrates into a gap between the accommodating groove and the guiding plate.

A linkage production method of the compact integrated high-speed folding machine as above-mentioned, comprising the steps of

S1 unwinding, the unwinding mechanism releasing a gauze roll, which passes through the edge-folding mechanism, the heating roller and the traction roller to reach the splitting mechanism in turn; wherein a misting and moistening device arranged around the unwinding mechanism mists and moistens the gauze released between the heating roller and the unwinding mechanism; and if producing gauze with a Barium sulfate thread, releasing a thread, that is, drawing out a barium sulfate thread in a barium sulfate thread box behind the unwinding mechanism, enabling it to reach the shaping wheel by way of passing through the barium sulfate thread drawing hook above the gauze then crossing the edge-folding mechanism, then to be pressed by a pressing wheel above through the Barium sulfate thread guiding groove and the heating roller;

S2 heating, the heating roller heating the gauze in a partitional manner, and controlling temperatures of a subsequent crease area and a barium sulfate thread area on the gauze, respectively; wherein the subsequent crease area folded on the gauze passes through a non-heating section of the heating roller, and the barium sulfate thread area and the rest on the gauze are heated through a heating section of the heating roller;

S3 splitting, the traction roller clamping the gauze and guiding it to a position between the bottom blade roller and the cutting blade roller, the bottom blade roller and the cutting blade roller rotating opposite to each other, and the cutting blade on the cutting blade roller pressing the gauze on the bottom blade of the bottom blade roller and cutting it off, so as to split the gauze into gauze sheets; wherein since the bottom blade is recessed in the bottom blade roller, while the cutting blade extends out of the cutting blade roller, after cutting off the gauze, ends of the gauze are instantaneously clamped by the bottom blade roller and the cutting blade roller, so as to avoid the gauze from rebounding and enable it to be split again;

S4 transferring after first-time inserting, an adsorption hole on the surface of the roller body of the bottom blade roller adsorbing the split-out gauze sheet on the surface of the roller body and the first-time inserting blade on the bottom blade roller supporting the split-out gauze sheet, at the occurrence that the bottom blade roller rotates, the first-time inserting blade inserting the front end of the gauze sheet into the folding-clamping seam of the big rotary drum; at the same time, the folding-clamping blade inside the folding-clamping seam clamping the gauze sheet, and after the bottom blade roller continues to rotate, the first-time inserting blade moving away from the folding-clamping seam; wherein the front end of the gauze sheet is folded by one-fourth;

S5 pressing after second-time inserting, at the occurrence that the big rotary drum drives the gauze sheet to reach the second-time inserting roller, the second-time inserting roller rotating and driving the second-time inserting blade to insert the rear end of the gauze sheet into the folding-clamping seam of the big rotary drum; at the same time, the folding-clamping blade inside the folding-clamping seam clamping the gauze sheet, the shifting fork lever before the second-time inserting blade turning over backwards to press the folded part of the front end of the gauze sheet; at the occurrence that the second-time inserting blade moves away from the folding-clamping seam after the second-time inserting roller continues to rotate, the shifting fork lever behind the second-time inserting blade turning over backwards to press the folded part of the rear end of the gauze sheet; wherein the rear end of the gauze sheet is folded by one fourth, the folded parts of both ends of the gauze are all pressed, and two ends of the folded gauze sheet correspond to each other, the area located between the two ends is an area of folding toward the middle;

S6 rolling midway, at the occurrence that the big rotary drum drives the gauze sheet to reach the pressure roller, the pressure roller rotating and driving the triple pressure head to roll the pressed gauze sheet; wherein two shifting fork levers pressing the gauze sheet are positioned in the spaces on two sides of the middle head of the triple press head;

S7 middle inserting against bursting, at the occurrence that the big rotary drum drives the gauze sheet to reach the second-time inserting roller, loosening the folding-clamping blade clamping the positions of the gauze sheet folded for the first time and the second time, the middle inserting roller rotating and driving the middle inserting blade to insert the middle part of the gauze sheet into the folding-clamping seam of the big rotary drum, enabling the folding-clamping blade inside the folding-clamping seam to clamp the gauze sheet, and arranging adsorption holes on both sides of the folding-clamping seam; at the same time, two shifting fork levers that press the gauze sheet turning over opposite to each other, releasing the portions of the gauze sheet folded for the first time and the second time; wherein the gauze sheet is folded toward the middle, and an adsorption force generated from the adsorption holes is exerted to two ends of the gauze sheet, so as to avoid the two ends of the gauze sheet from falling down and bursting due to its self-weight;

S8 adsorbing and transferring, at the occurrence that the big rotary drum drives the gauze sheet to reach the adsorbing-transferring mechanism, loosening the folding-clamping blade at the position of folding toward the middle, an adsorption force generated from the adsorption valve being larger than adsorption forces from the adsorption holes on both sides of the folding-clamping seam, the adsorption valve adsorbing the gauze sheet, and the adsorbing-transferring mechanism driving the adsorption valve to rotate, so as to transfer the gauze sheet; wherein the gauze sheet folded 3 times forms a gauze strip, of which the length direction is same as the direction of the negative pressure shaft of the adsorbing-transferring mechanism;

S9 folding for the fourth time, at the occurrence that the adsorption valve reaches the hooking-folding mechanism, enabling the hooking-folding plate to be positioned in the hooking-pulling groove of the adsorption valve, at the same time, at the occurrence that the longitudinal sliding stand drives the hooking-folding plate to move away from the hooking-pulling groove, the hooking-folding plate hooking the gauze strip and retracting into the gap between the accommodating groove and the guiding plate, enabling two sides of the gap to fold the gauze strip; wherein the gauze strip is folded by one-third from one end;

S10 pressing, the sliding plate driving the buffer through the guiding plate, so as to press four folded positions of the gauze strip on the wallboard outside the accommodating groove, and the longitudinal sliding stand driving the hooking-folding plate to move away from the hooking-pulling groove, enabling the pushing plate to move away the end of the accommodating groove synchronously together with the longitudinal sliding stand;

S11 folding for the fifth time, the sliding plate driving the buffer to move toward one side, so as to release the pressure on the fold positions of the gauze strip; at the same time, the horizontal sliding stand driving the inserting-folding plate to pass through the folding-seam opening on the guiding plate and the accommodating groove to fold the gauze strip from the other end by one-third, and enabling the part to coincide with the folded one-third part; wherein the folding gauze is located in the accommodating groove and the horizontal sliding stand drives the inserting-folding plate to move away from the folding-seam opening; and

S12 accommodating, in the process that the hooking-folding plate retracts into the gap between the accommodating groove and the guiding plate, the pushing plate synchronously retracting and sliding inside the accommodating groove, pushing the folded gauze inside the accommodating groove backwards.

The present disclosure mainly has the following beneficial effects.

The splitting mechanism, the inserting-folding mechanism and the adsorbing-transferring mechanism are distributed around the big rotary drum and connected with the wallboard, and the bottom blade roller of the splitting mechanism and the middle inserting roller of the inserting-folding mechanism are respectively positioned at the upper and lower ends of the vertical center line of the big rotary drum; thus, this arrangement not only greatly reduces the overall height, but also make it easy to arrange the unwinding mechanism and the adsorbing-transferring mechanism on both sides of the vertical centerline of the big rotary drum to be connected to the wallboard, thereby reducing the overall length.

The big rotary drum cooperates with the splitting mechanism and the inserting-folding mechanism to enable the gauze sheet to be folded many times in the axial direction, and finally form a gauze strip.

The gauze strip is transferred to the hooking-folding mechanism through the adsorbing-transferring mechanism, and folded in the radial direction by the hooking-folding mechanism.

Two unwinding mechanisms used to unwind synchronously make it possible to produce a gauze sheet with and without a barium sulfate thread, and produce both at the same time.

The barium sulfate thread adheres to the gauze sheet as a whole at the heating roller, and the gauze sheet is synchronously split and folded in the splitting and folding process, so that it is impossible to waste the barium sulfate thread.

BRIEF DESCRIPTION OF THE DRAWINGS

We shall further describe the present disclosure in combination with the drawings and examples as follows.

Where, 1—big rotary drum; 11—folding-clamping seam; 110—negative pressure cavity; 12—adsorption hole; 13—hollow shaft; 131—through hole; 14—folding-clamping blade; 140—folding-clamping mechanism; 15—shifting fork lever; 150—shifting fork mechanism; 16—stationary track disk; 17—mobile track disk; 2—splitting mechanism;

21—bottom blade roller; 211—bottom blade; 212—first-time inserting blade; 22—cutting blade roller; 221—cutting blade; 23—traction roller; 3—inserting-folding mechanism; 31—second-time inserting roller; 311—second-time inserting blade; 32—pressure roller; 321—triple pressure head; 33—middle inserting roller; 331—middle inserting blade; 4—adsorbing-transferring mechanism; 41—negative pressure shaft; 42—adsorption valve; 421—adsorbing-transferring hole; 422—groove hole; 43—hooking-pulling groove; 5—unwinding mechanism; 6—hooking-folding mechanism; 61—longitudinal sliding stand; 62—hooking-folding plate; 63—pushing plate; 64—horizontal sliding stand; 65—inserting-folding plate; 66—accommodating groove; 660—folding-seam opening; 67—guiding plate; 68—buffer; 69—sliding plate; 7—heating roller; 700—pressure wheel; 71—barium sulfate thread guiding groove; 72—barium sulfate thread drawing hook; 720—edge-folding mechanism; 721—transition roller; 722—edge-pressing lever; 723—shaping wheel.

DETAILED DESCRIPTION OF SOME EMBODIMENTS

Figure 1:
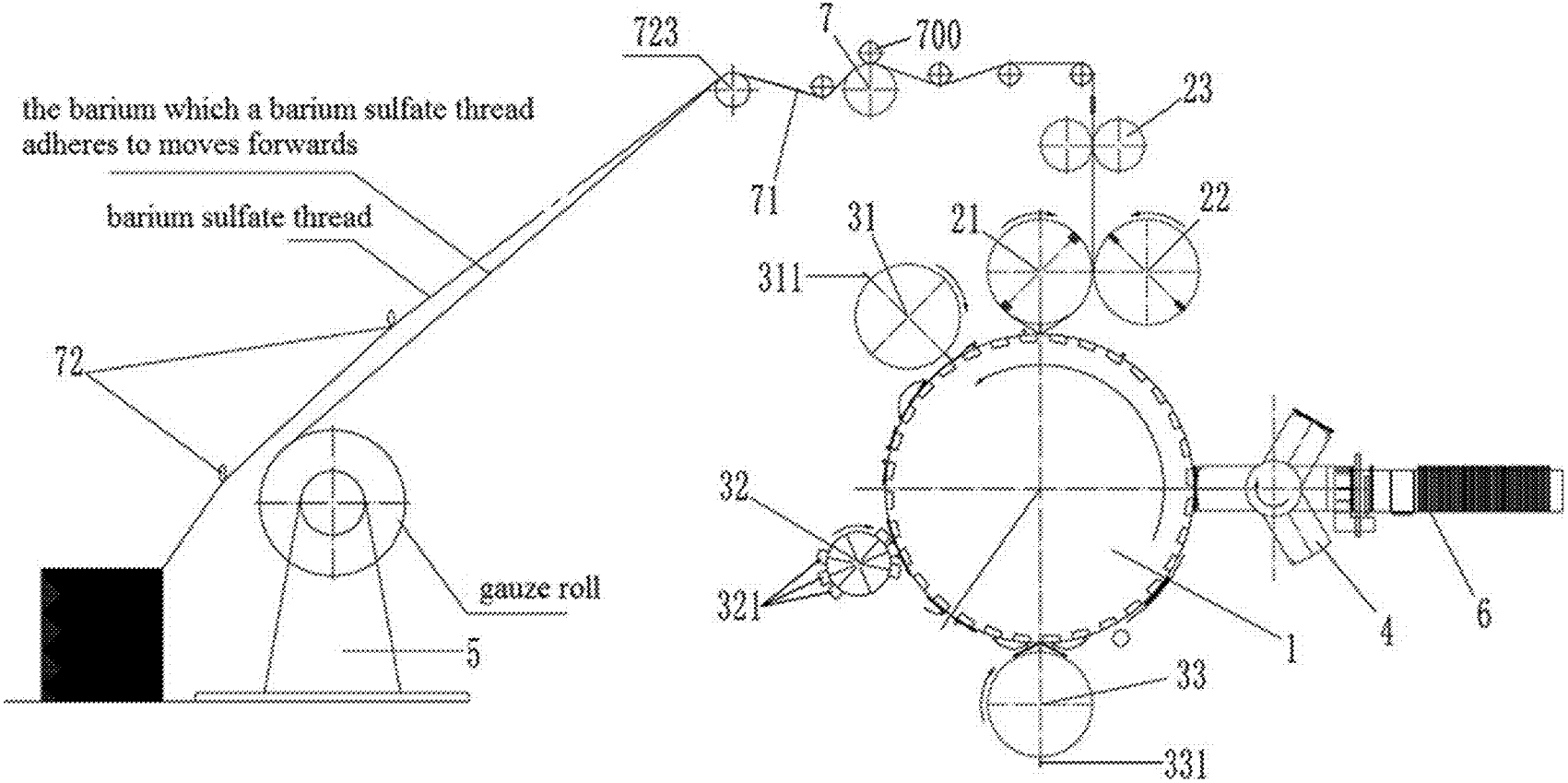
FIG. 1 is a flow chart of the present disclosure.
Figure 2:
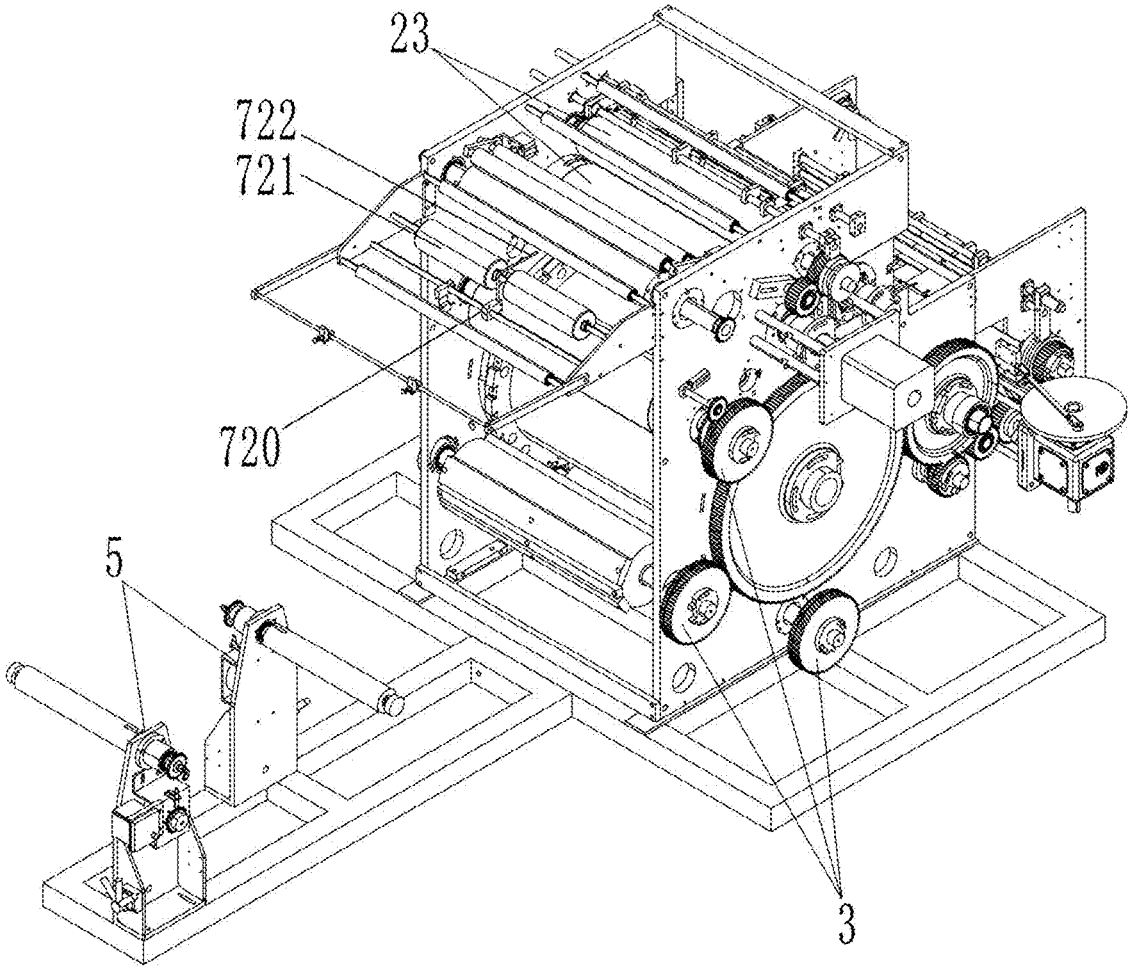
FIG. 2 is a diagram illustrating the structure of an equiaxial side in the present disclosure.
Figure 3:
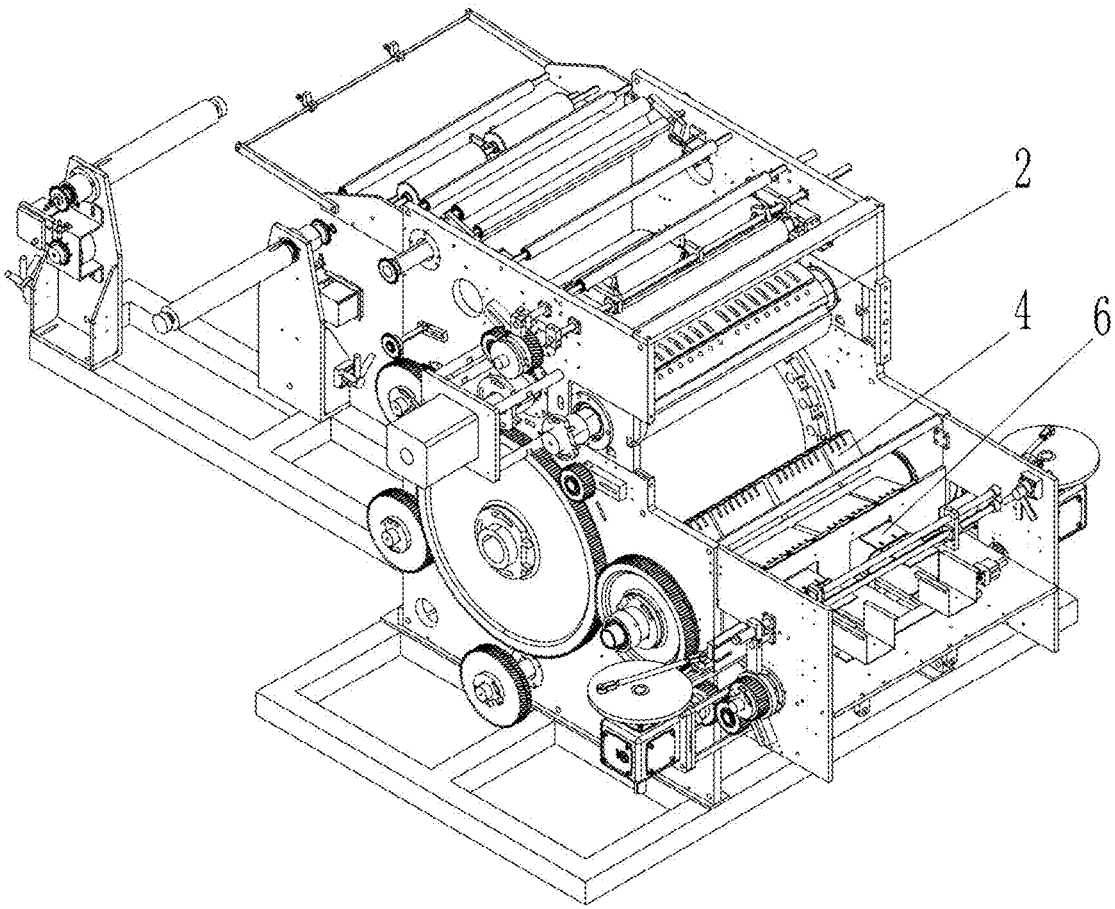
FIG. 3 is a diagram illustrating the structure of another equiaxial side in the present disclosure.
Figure 4:
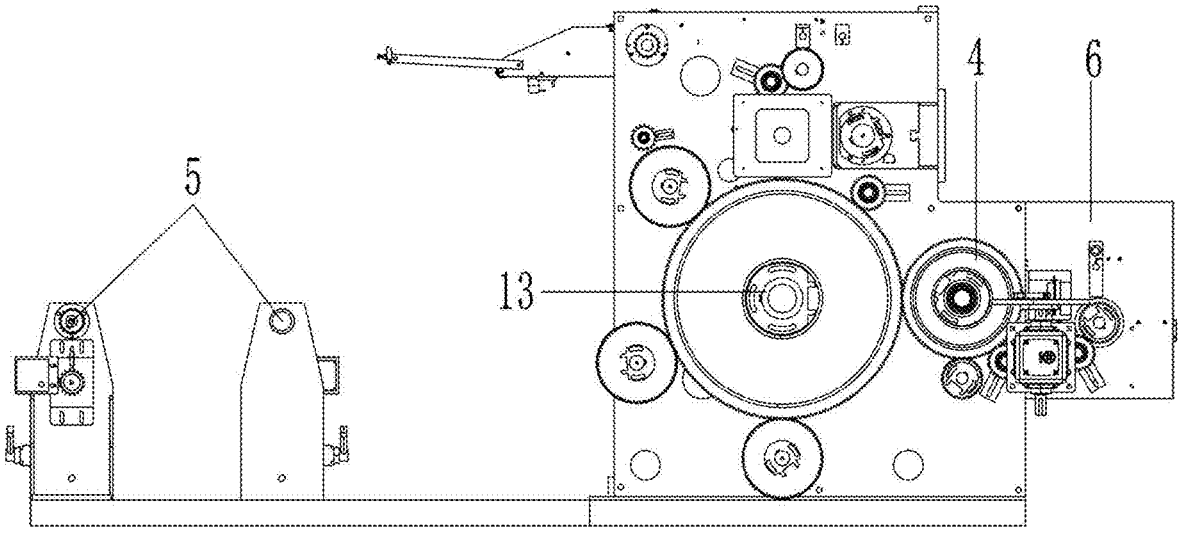
FIG. 4 is a main view of FIG. 2.
Figure 5:
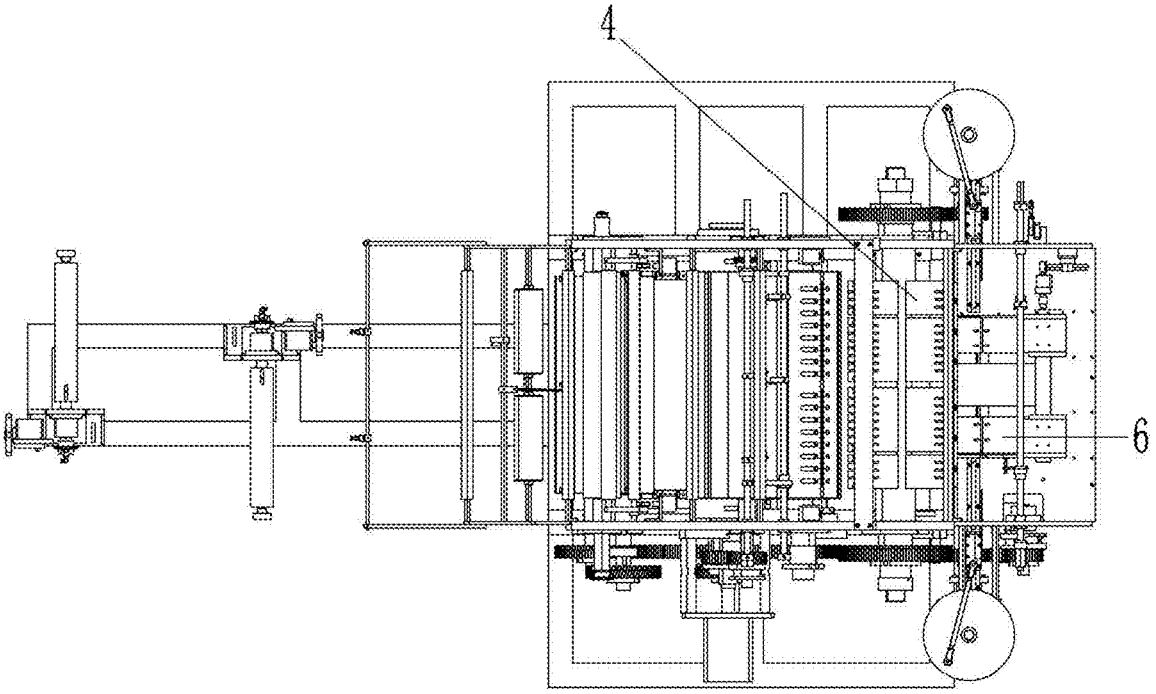
FIG. 5 is a top view of FIG. 4.
Figure 6:
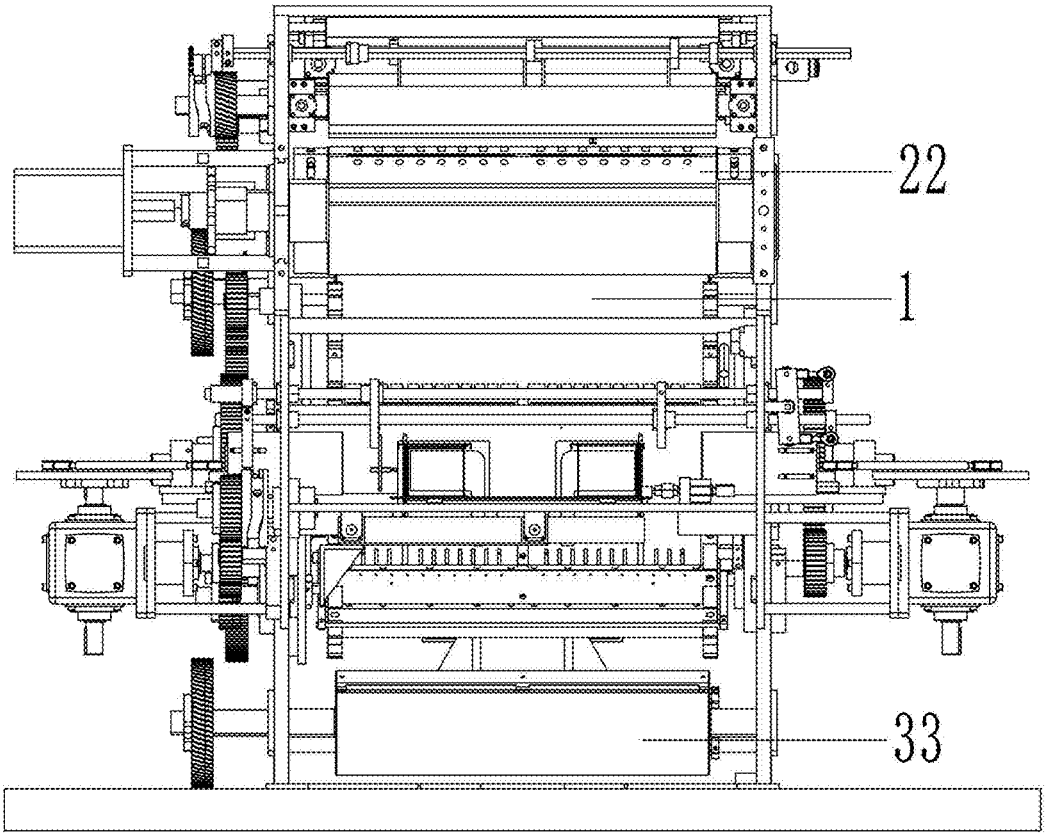
FIG. 6 is a right view of FIG. 4.
Figure 7:
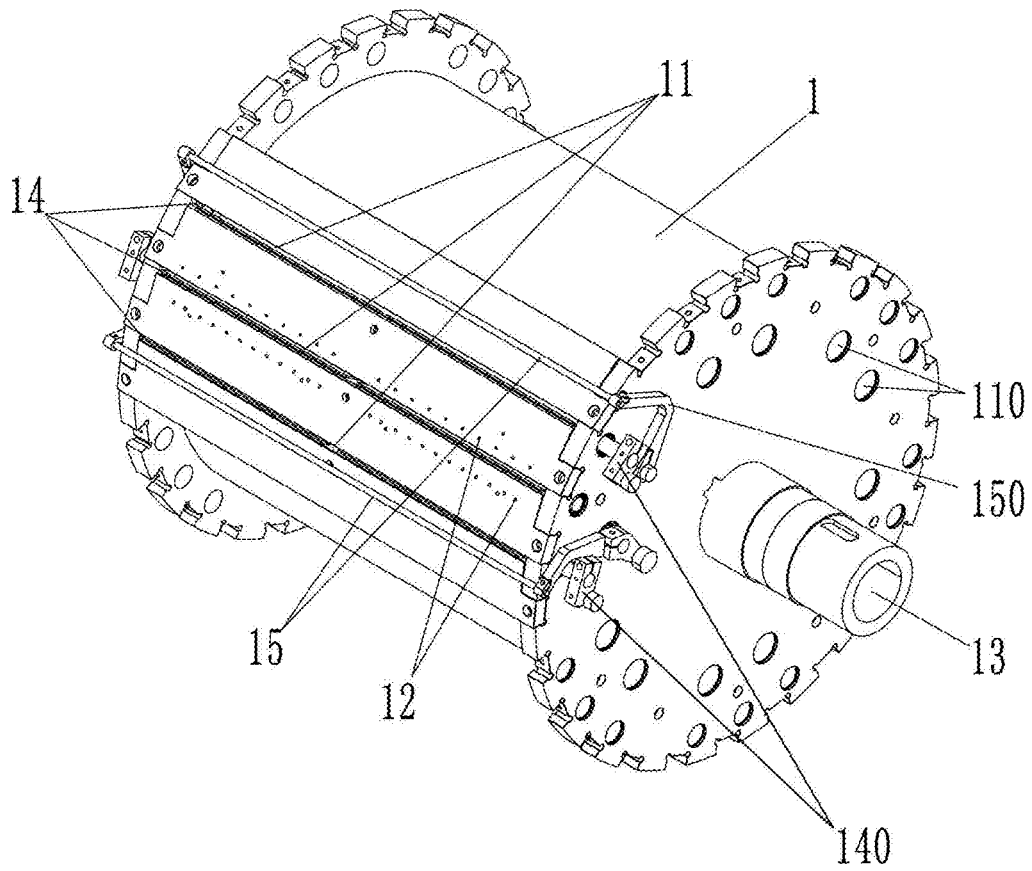
FIG. 7 is a diagram illustrating a partial structure of the big rotary drum in the present disclosure.
Figure 8:
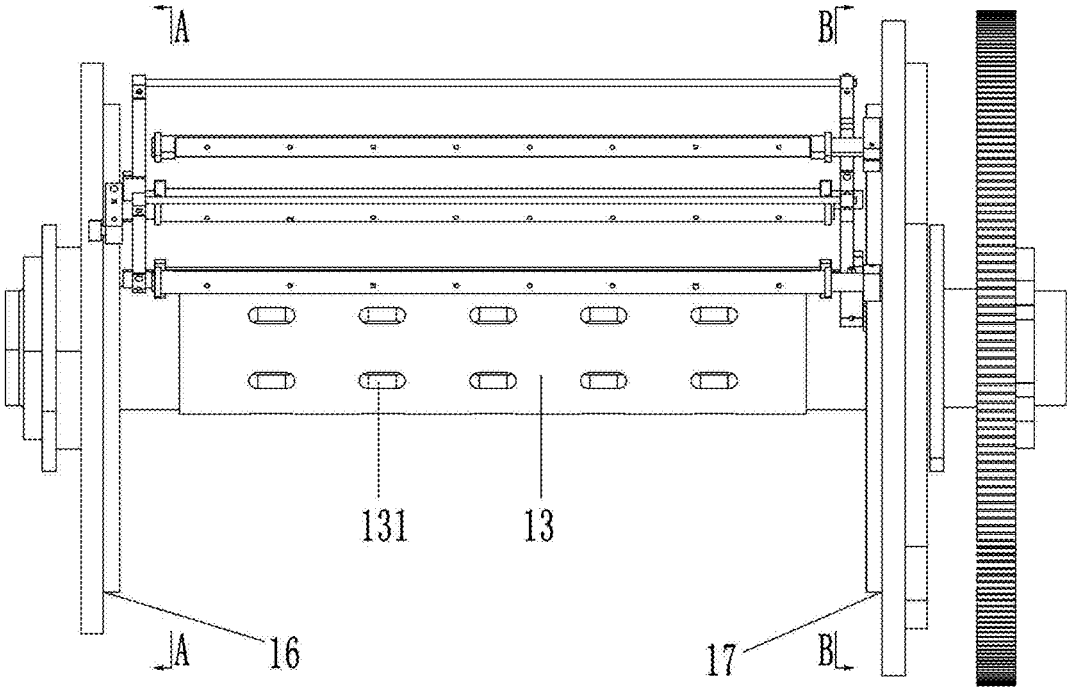
FIG. 8 is main view showing the cooperation of the big rotary drum with the stationary track disk and the mobile track disk in the present disclosure.
Figure 9:
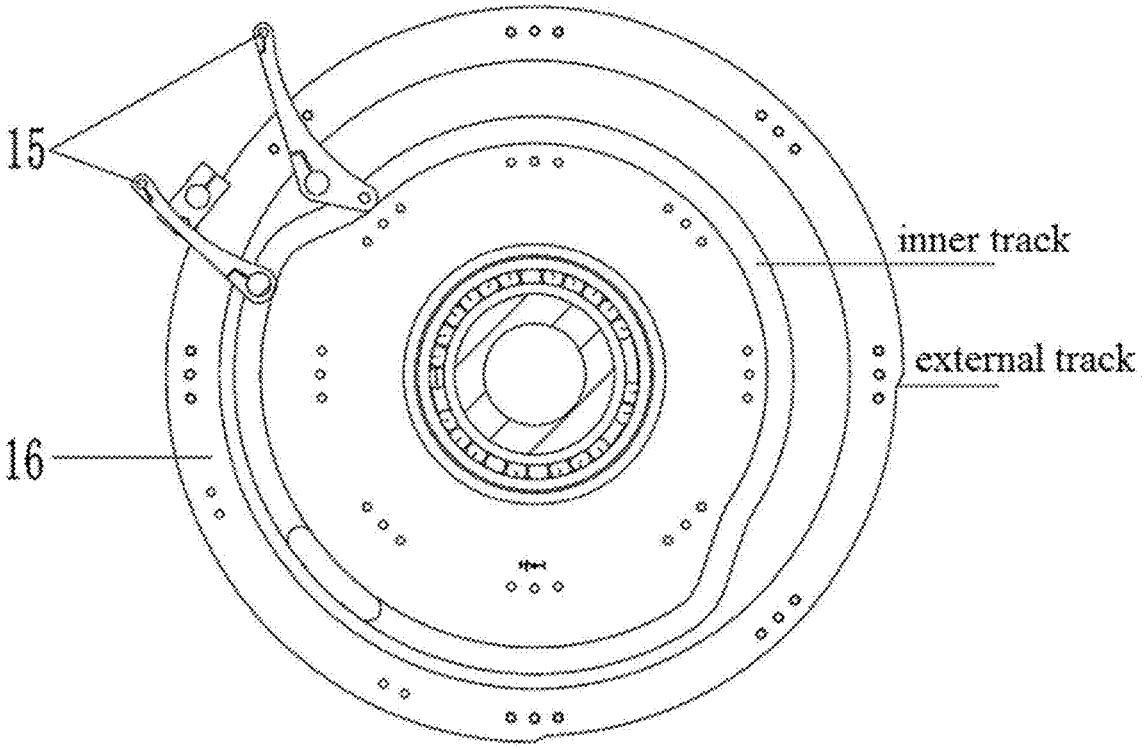
FIG. 9 is a cutaway view at A-A of FIG. 8.
Figure 10:
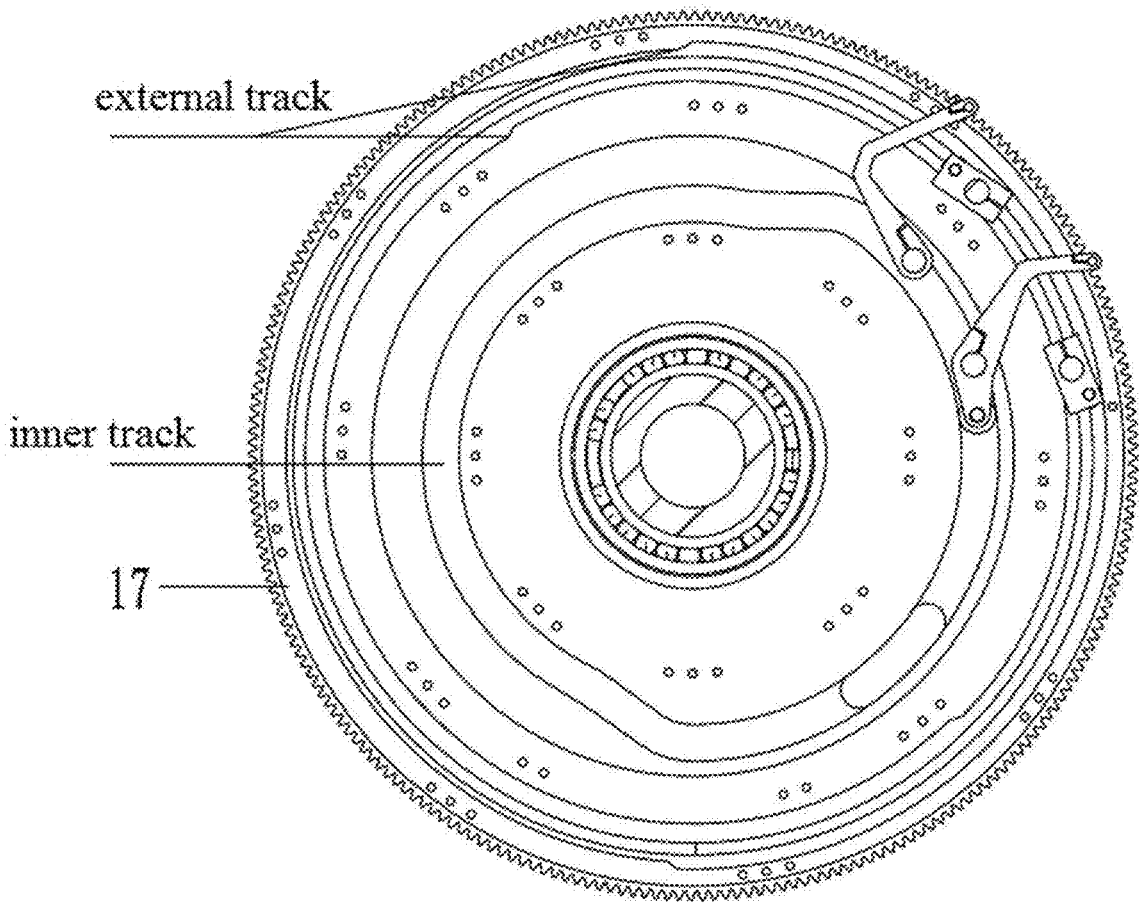
FIG. 10 is a cutaway view at B-B of FIG. 8.
Figure 11:
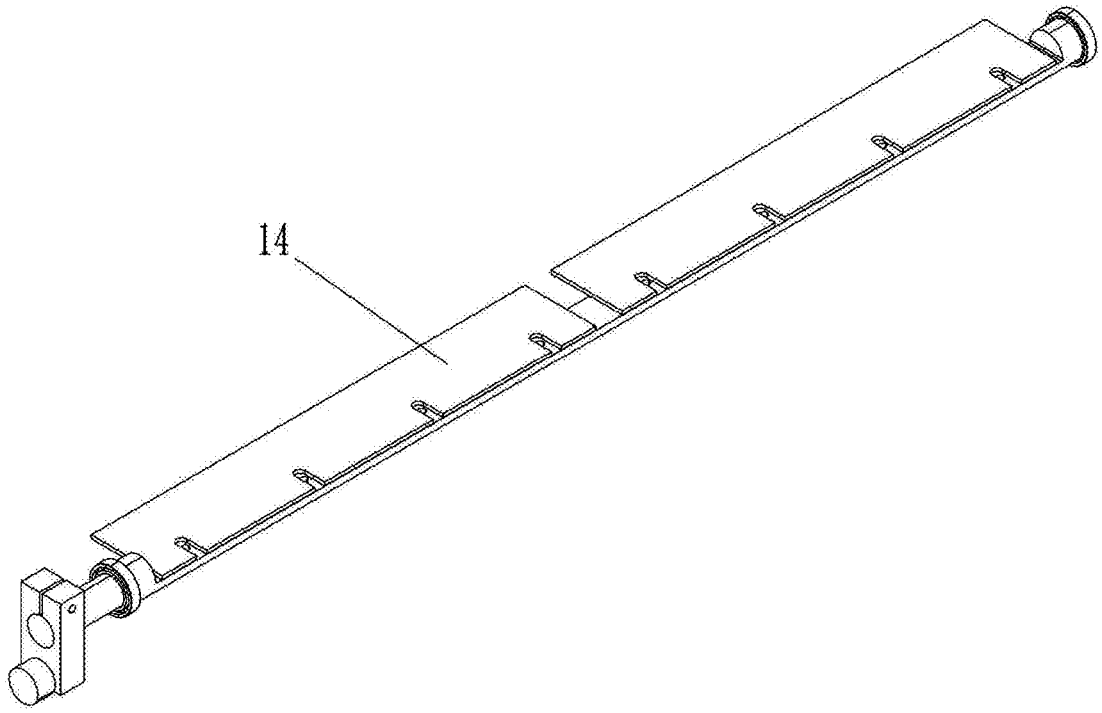
FIG. 11 is a structure diagram of the folding-clamping mechanism connected to the big rotary drum in the present disclosure.
Figure 12:
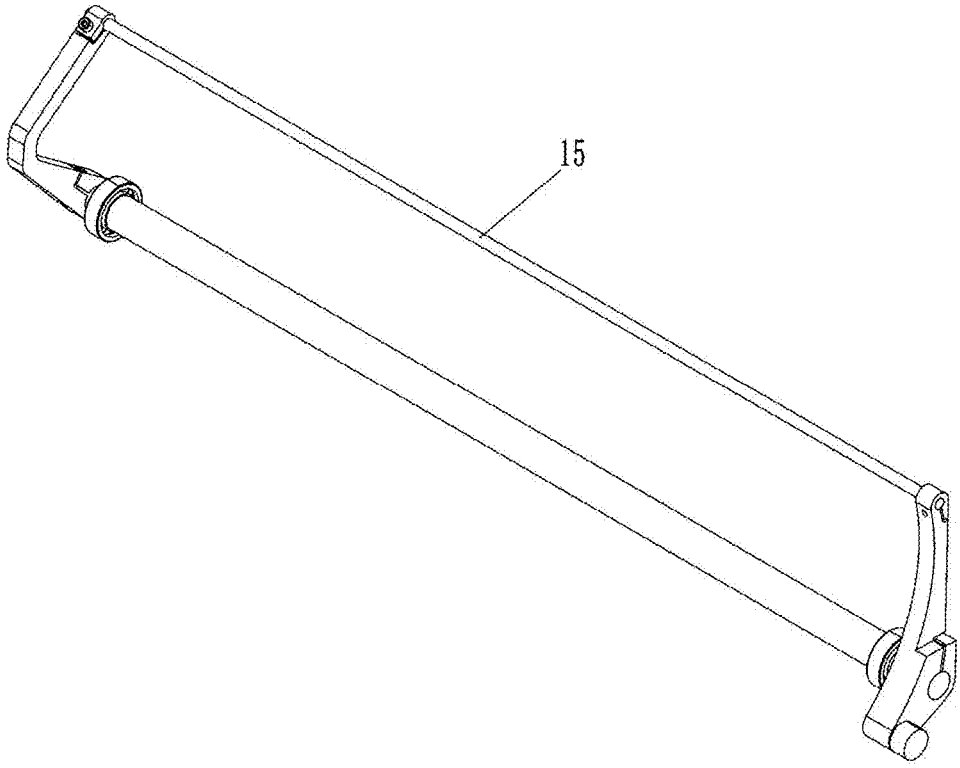
FIG. 12 is a structure diagram of the shifting fork mechanism connected to the big rotary drum in the present disclosure.
Figure 13:
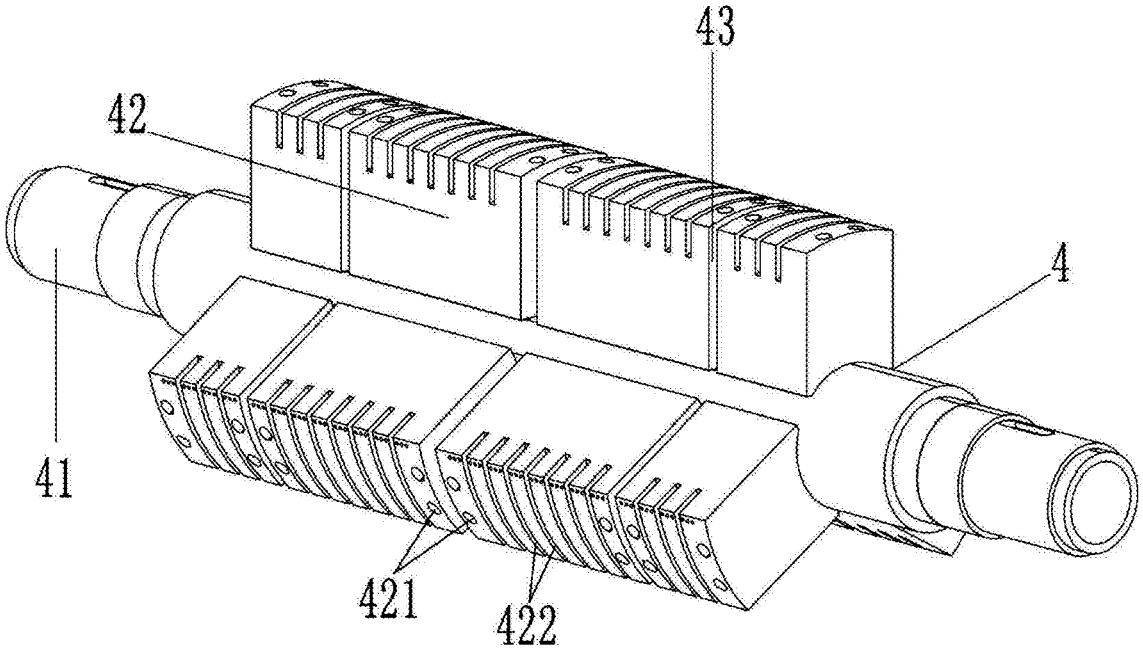
FIG. 13 is a structure diagram of the adsorbing-transferring mechanism in the present disclosure.
Figure 14:
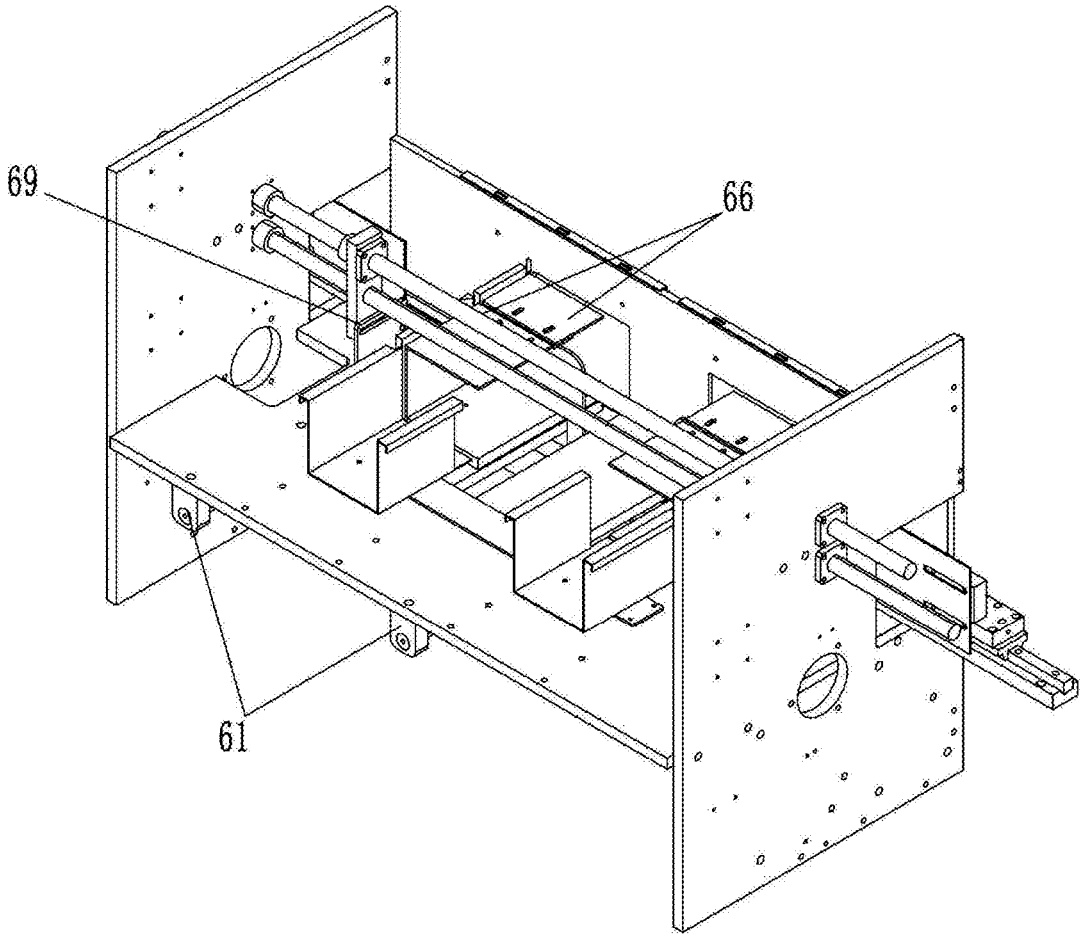
FIG. 14 is a structure diagram of the hooking-folding mechanism in the present disclosure.
Figure 15:
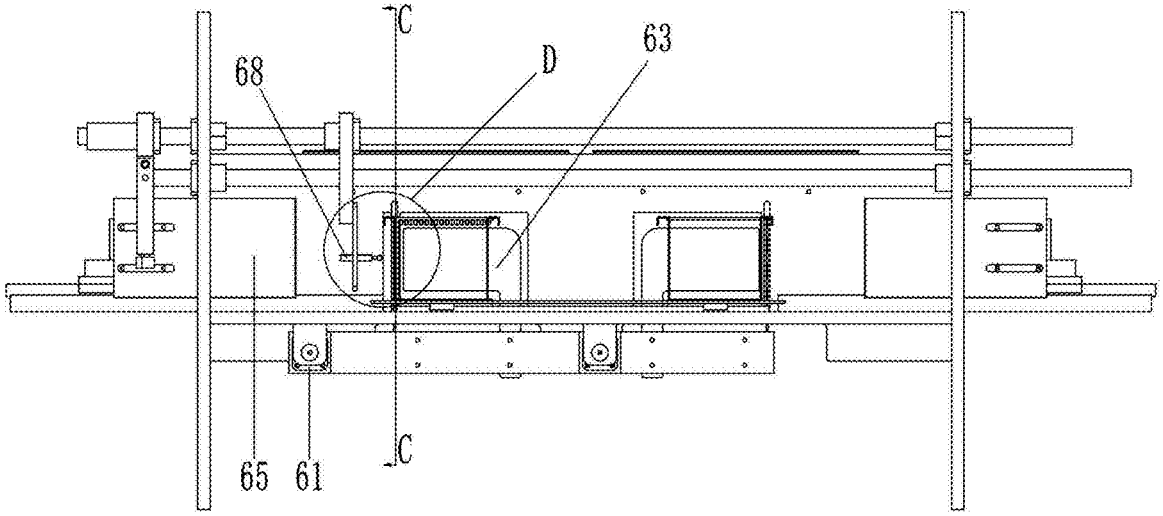
FIG. 15 is a main view of FIG. 14.
Figure 16:
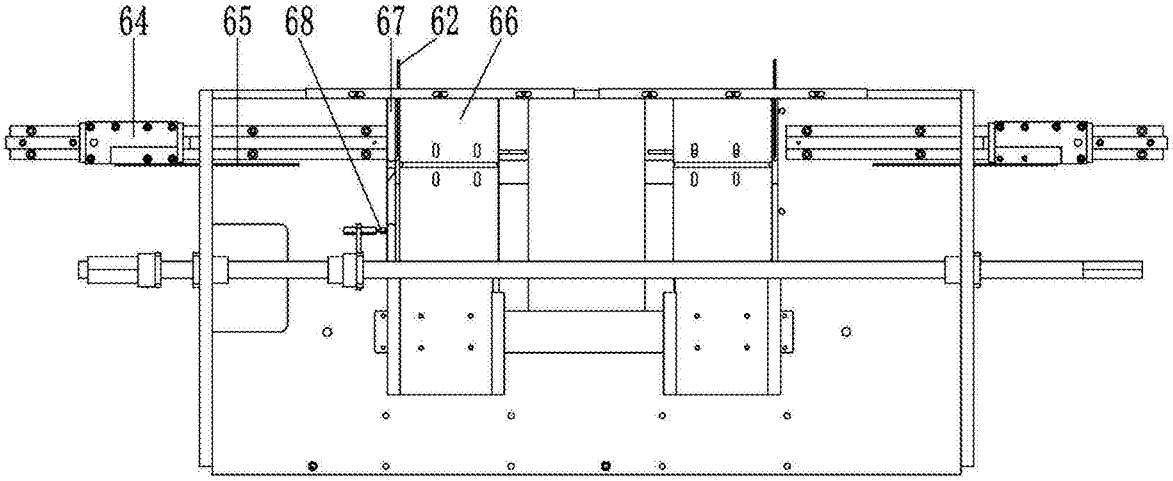
FIG. 16 is a top view of FIG. 15.
Figure 17:
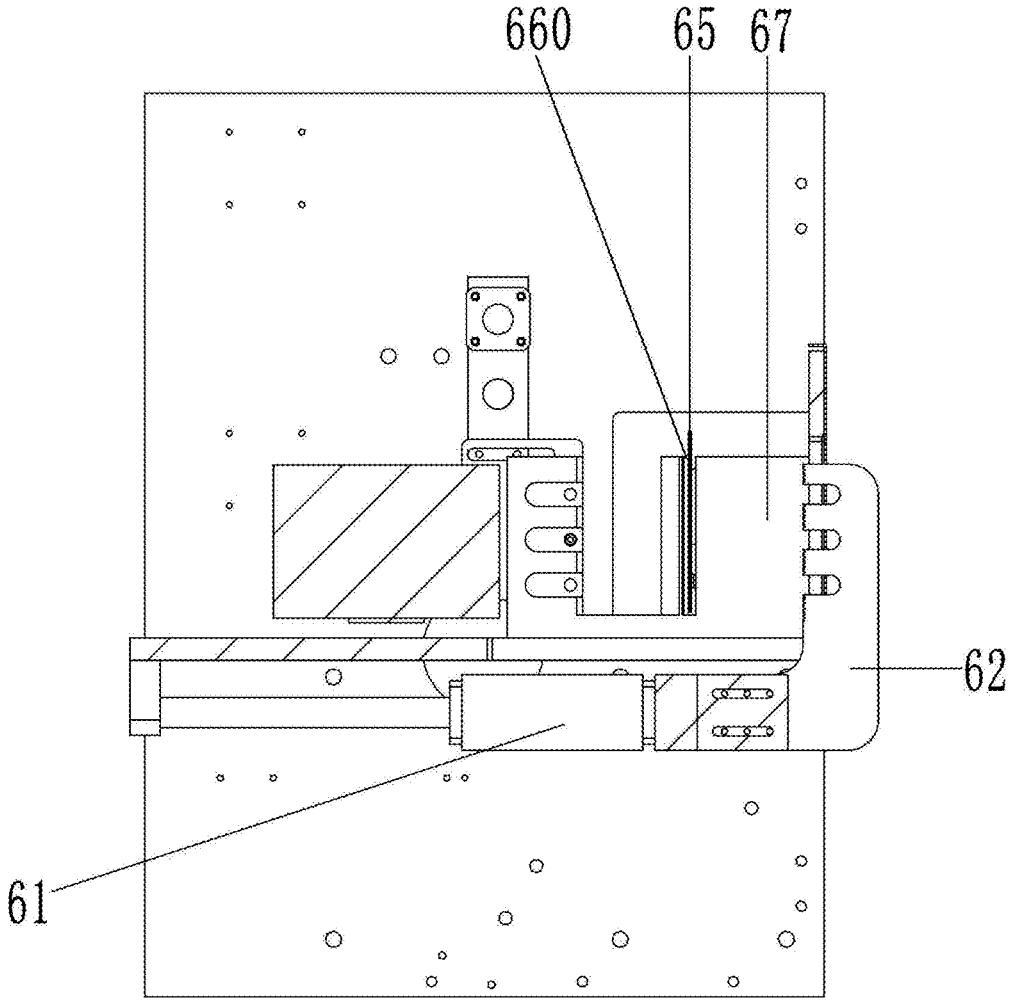
FIG. 17 is a cutaway view at C-C of FIG. 15.
Figure 18:
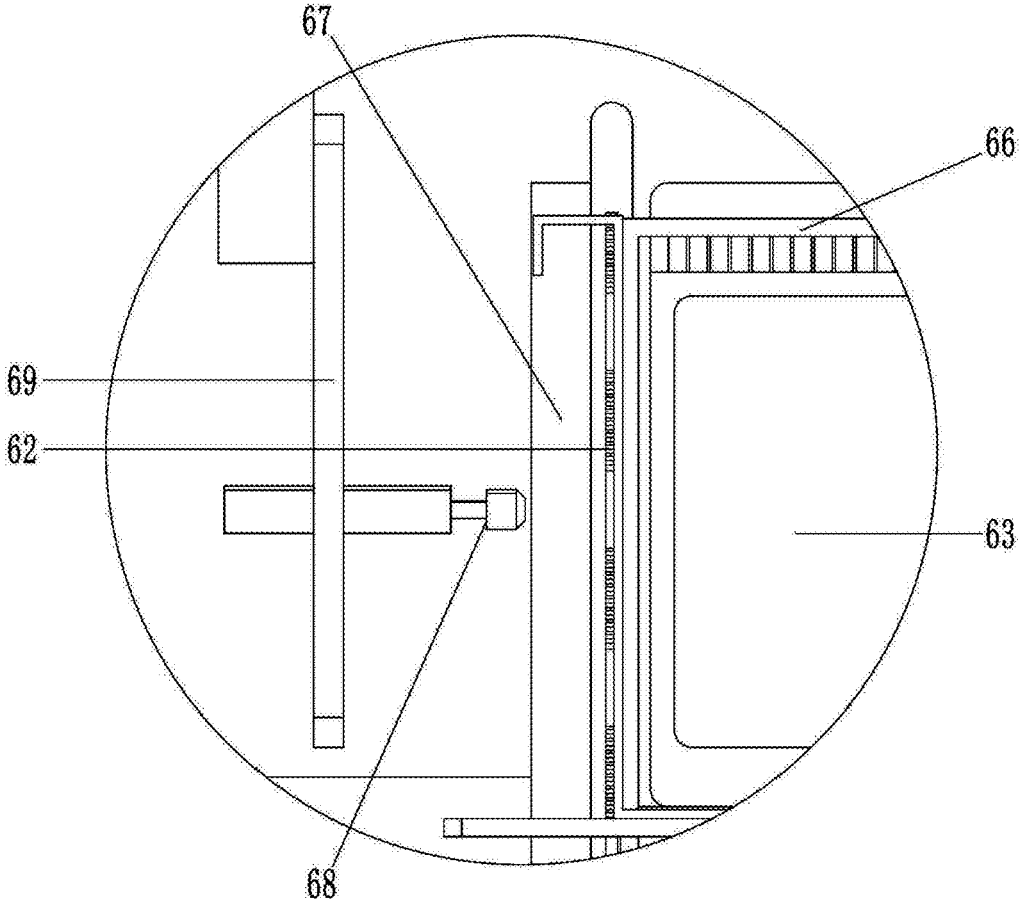
FIG. 18 is an enlarged view at D of FIG. 15.
Figure 19:
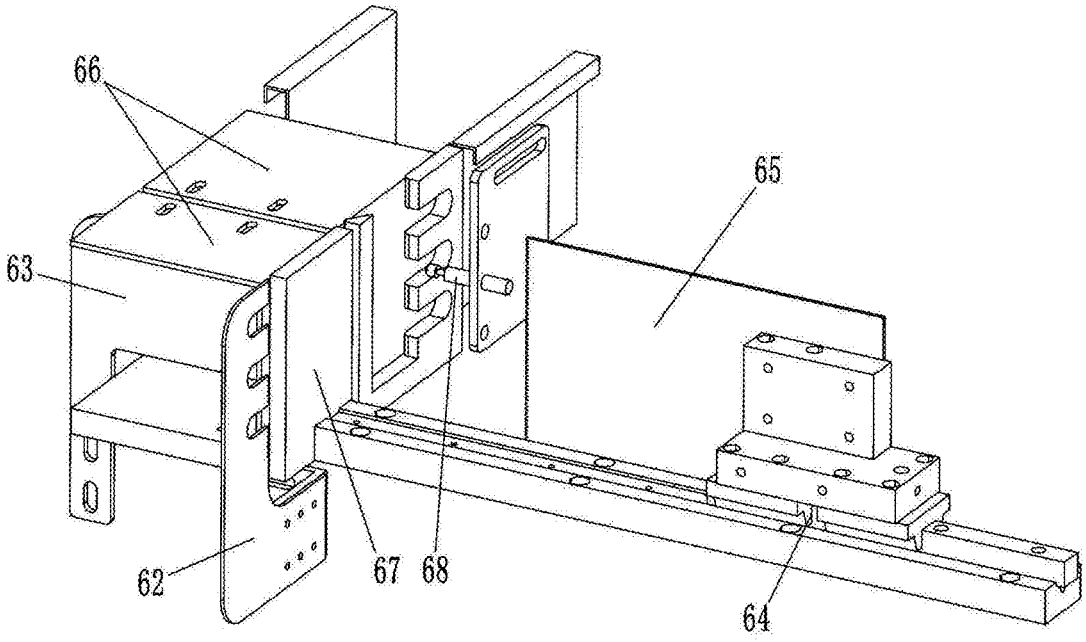
FIG. 19 is a diagram showing the position relation between the hooking-folding plate and the inserting-folding plate of the hooking-folding mechanism in the present disclosure.
Figure 20:
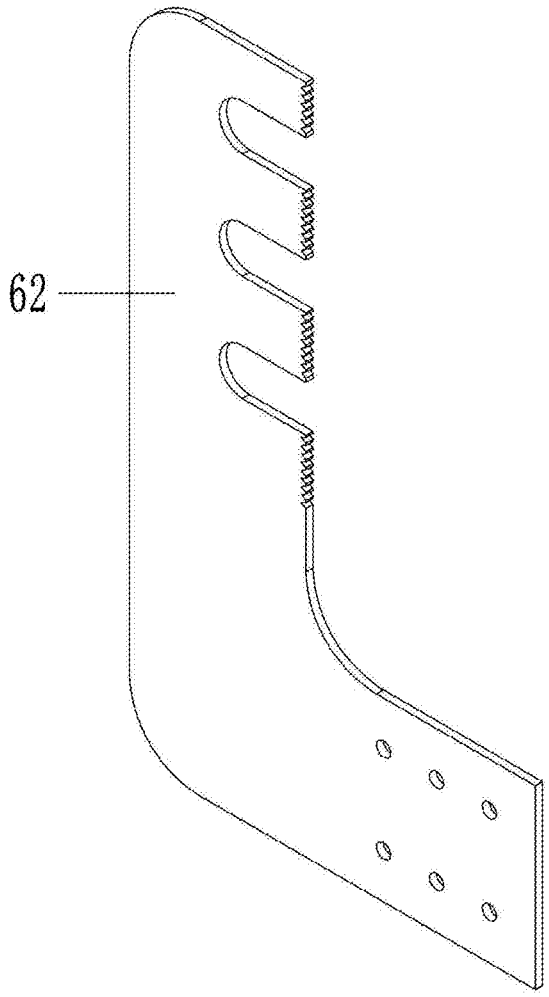
FIG. 20 is a structure diagram of the hooking-folding plate in the present disclosure.
Figure 21:
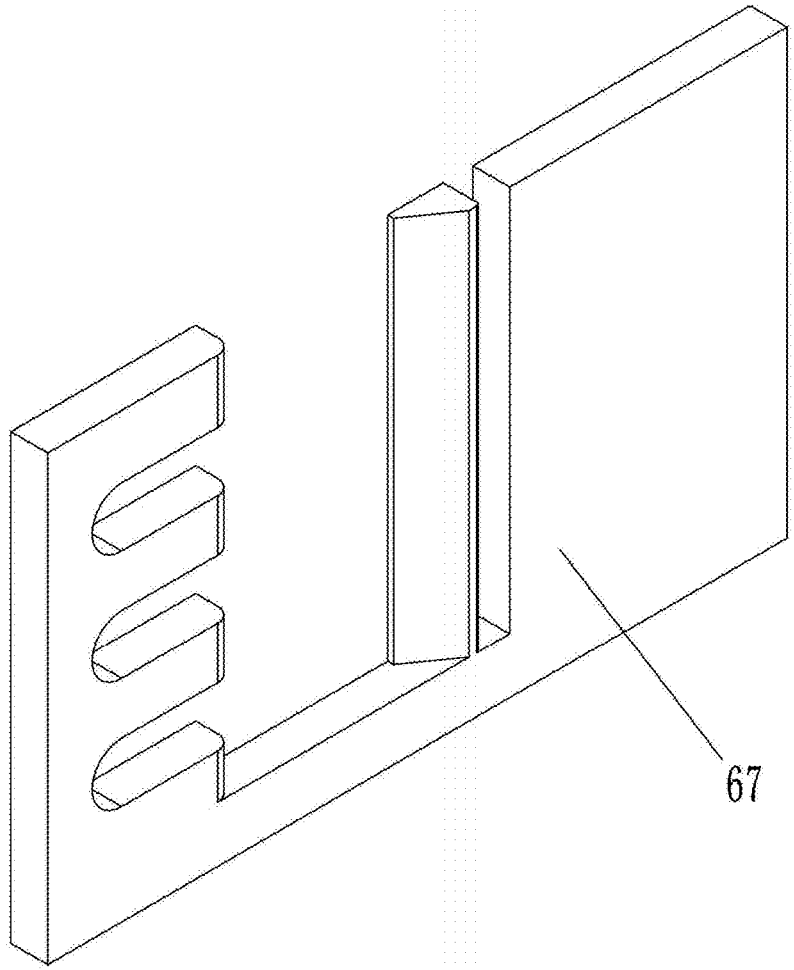
FIG. 21 is a structure diagram of the guiding plate in the present disclosure.
Figure 22:
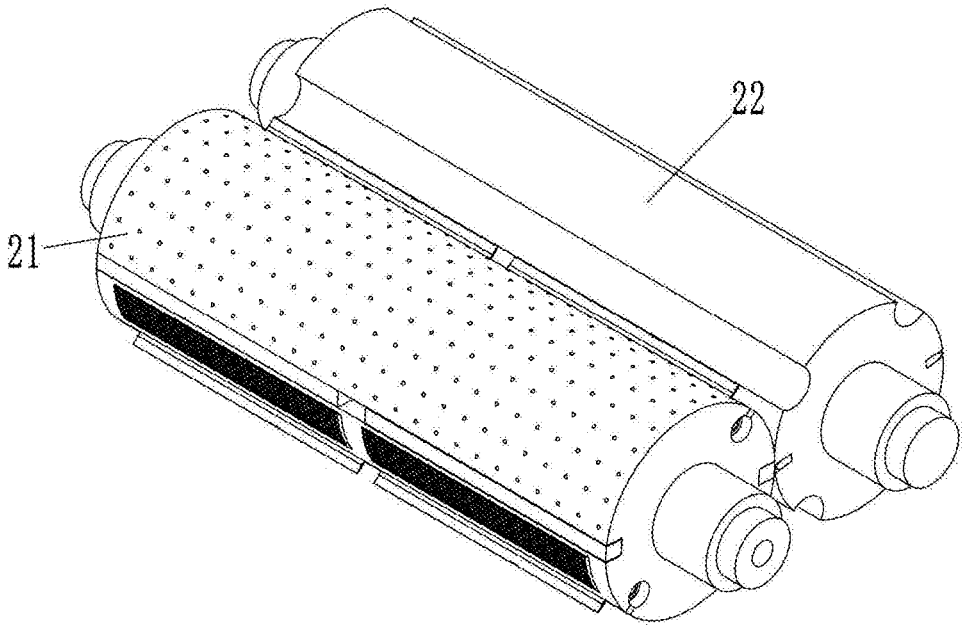
FIG. 22 is a structure diagram of the bottom blade roller and the cutting blade roller in the present disclosure.
Figure 23:
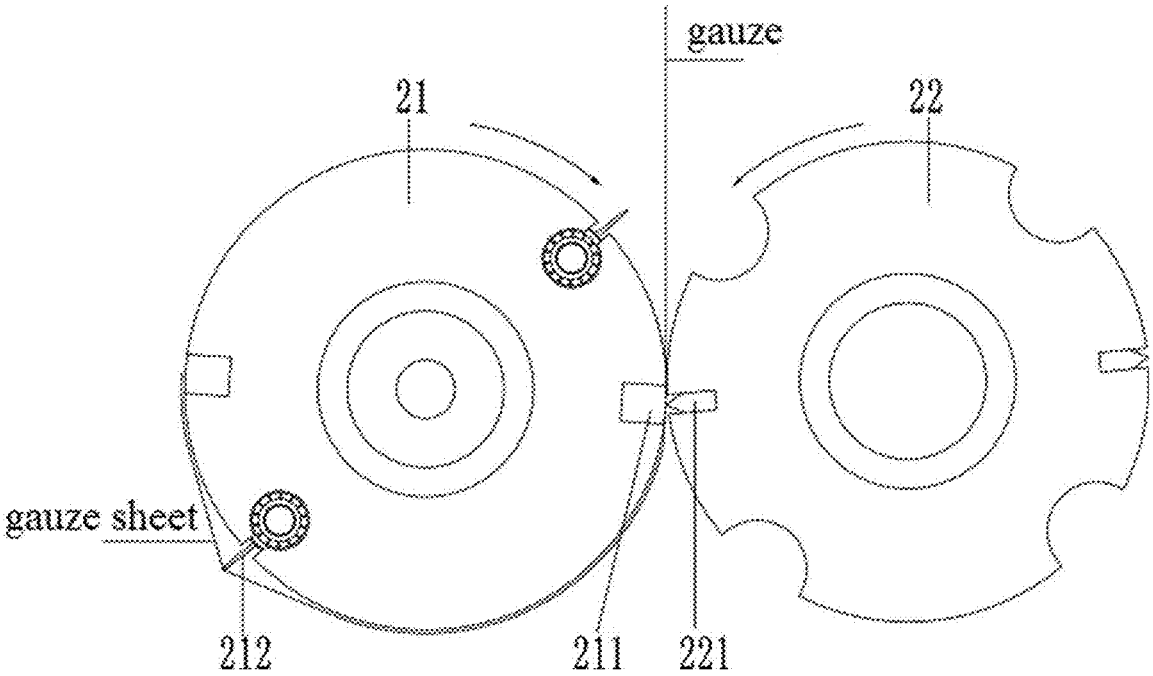
FIG. 23 is a state diagram showing that the bottom blade roller and the cutting blade roller cooperate with each other to split gauze in the present disclosure.

As shown in FIGS. 1-23, a compact integrated high-speed folding machine includes a big rotary drum 1, a splitting mechanism 2, an inserting-folding mechanism 3, an adsorbing-transferring mechanism 4, a unwinding mechanism 5 and a hooking-folding mechanism 6; and a bottom blade roller 21 of the splitting mechanism 2 and a middle inserting roller 33 of the inserting-folding mechanism 3 are respectively positioned at the upper and lower ends of the vertical center line of the big rotary drum 1; the adsorbing-transferring mechanism 4 and the unwinding mechanism 5 are respectively positioned on both sides of the vertical center line, and the hooking-folding mechanism 6 is arranged on one side of the adsorbing-transferring mechanism 4; the splitting mechanism 2 is splitting a gauze sheet, while adsorbing, drawing and transferring another gauze sheet. During operation, the gauze sheet can be folded many times in the axis direction on the big rotary drum 1, then continuously transferred to the hooking-folding mechanism 6, on which the gauze sheet is folded many times in the radial direction, synchronously producing a gauze sheet with and without a barium sulfate thread.

In a preferred design, a heating roller 7 is further arranged between the unwinding mechanism 5 and the splitting mechanism 2, and a barium sulfate thread guiding groove 71 is arranged in the front of the heating roller 7; the heating roller 7 has a segmented heating structure.

Preferably, the unwinding mechanism 5 includes a unwinding frame, a unwinding shaft connected to the unwinding frame, and a motor connected to the unwinding shaft, and a gauze roll is matched with the unwinding shaft; thus, the motor drives the unwinding shaft to release the gauze roll.

Preferably, the unwinding mechanism 5 is configured to be two groups, and the gauze roll is released synchronously during operation.

Preferably, the heating roller 7 has a segmented heating structure; when the gauze passes through the heating roller, firstly misting and moistening the gauze, then heating the gauze except a crease along which it needs to be folded, for the purpose of making the crease keep wet and softer than the rest of the gauze, so as to make it easier to turn over and fold the gauze sheet during subsequent folding operation.

Preferably, in the case of producing the gauze sheet to which a barium sulfate thread adheres, taking the end of the barium sulfate thread out from a barium sulfate thread box, and drawing it into a heating roller 7 from the barium sulfate thread guiding groove 71, then using the heating roller 7 to heat the barium sulfate thread, and utilizing a pressure wheel 700 of the upper part of the heating roller 7 to press the barium sulfate thread and make it adhere to the gauze.

Preferably, the barium sulfate thread guiding groove 71 is used to guide the barium sulfate thread and make it positioned in the area set with the gauze sheet, and the area where the barium sulfate thread is positioned is a heating area.

In a preferred design, folding-clamping seams 11 are disposed on the drum wall of the big rotary drum 1, adsorption holes 12 arranged on both sides of one folding-clamping seam 11 between every two folding-clamping seams 11 lead to a negative pressure cavity 110 of the big rotary drum 1, and a through hole 131 arranged on a hollow shaft 13 that passes through the drum body leads to the negative pressure cavity 110; a folding-clamping blade 14 of a folding-clamping mechanism 140 is positioned and configured to swing inside the folding-clamping seam 11, and a shifting fork lever 15 of a shifting fork mechanism 150 is positioned and configured to turn over at the upper part of the folding-clamping seam 11. During operation, the hollow shaft 13 at one end of the big rotary drum 1 leads to a vacuum pump, so that a negative pressure is formed in the negative pressure chamber 110 inside the drum body, so as to enable the adsorption hole 12 to generate produces an adsorption force.

Preferably, the folding-clamping mechanism 140 includes a folding-clamping shaft, a folding-clamping blade 14 connected to the folding-clamping shaft, and a clamping block positioned and connected at one end of the folding-clamping shaft, wherein a folding-clamping roller is connected to the clamping block. During installing, the folding-clamp shaft passes through toothed plates at two ends of the drum body and fits with them, and the folding clamp roller is positioned outside the toothed plates and rotationally matched with a stationary track disk 16 or a mobile track disk 17.

Preferably, the shifting fork mechanism 150 includes a shifting fork shaft, swing arms connected at two ends of the shifting fork shaft, and a shifting fork lever 15 connected to the swing arm, wherein a shifting fork roller is connected to one of the swing arms; During installing, the shifting fork shaft passes through the drum body and fits with it, and the shifting fork roller is rotationally matched with the stationary track disk 16 or the mobile track disk 17.

In a preferred design, two ends of the hollow shaft 13 are also respectively matched with a stationary track disk 16 or a mobile track disk 17, and the folding-clamping mechanism 140 and the shifting fork mechanism 150 fit with the stationary track disk 16 and the mobile track disk 17. During installing, the stationary track disk 16 is connected and fixed to a wallboard, and the mobile track disk 1 is connected to the hollow shaft 13; thus, at the time of rotating the hollow shaft 13 drives the mobile track disk 17 and the big rotary drum 1 to rotate together, and the folding-clamping mechanism 140 and the shifting-fork mechanism 150 that are connected with the big rotary drum 1 rotate synchronously with it.

Preferably, the stationary track disk 16 or the mobile track disk 17 all have an inner track and an external track, and the folding-clamp roller of the folding-clamping mechanism 140 is matched with the external track, while the shifting fork roller of the shifting fork mechanism 150 is matched with the inner track.

Preferably, of a plurality of folding-clamping rollers one part are distributed on the external track of the stationary track disk 16, and the other part are distributed on the external track of the mobile track disk 17.

Preferably, of a plurality of shifting fork rollers one part are distributed on the inner track of the stationary track disk 16, and the other part are distributed on the inner track of the mobile track disk 17.

Preferably, in the process of matching the folding-clamping roller with the external track, the folding-clamping shaft is driven to make the folding-clamping blade 14 swing at each folding-clamping node while the big rotary drum 1 is rotating, so as to clamp the crease of the gauze sheet or release the clamping.

Preferably, in the process of matching the shifting fork roller with the inner track, the swing arm is driven to make the shifting fork shaft rotate, at the time of rotating the shifting fork shaft drives the shifting fork lever 15 to turn over at each pressure node while the big rotary drum 1 is rotating, so as to press the folded portion of the gauze sheet or release the pressure.

In a preferred design, the splitting mechanism 2 includes a cutting blade roller 22 matched with the bottom blade roller 21, and a traction roller 23 also arranged at the upper parts of the bottom blade roller 21 and the cutting blade roller 22; a bottom blade 211 and a cutting blade 221 are respectively disposed on the cutting blade roller 22 and the bottom blade roller 21, the bottom blade 211 and the cutting blade 221 hit against each other at a cutting point, and the bottom blade 211 is recessed in the bottom blade roller 21, while the cutting blade 221 extends out of the cutting blade roller 22. During operation, the traction roller 23 is mainly used to pull the gauze between the bottom blade roller 21 and the cutting blade roller 22, and cut off the gauze through the bottom blade 211 and the cutting blade 221 on the bottom blade roller 21 and the cutting blade roller 22 to form a gauze sheet.

Preferably, the diameter of the bottom blade roller 21 is less than the diameter of the cutting blade roller 22 by 1-3 mm.

Preferably, the bottom blade roller 21 and the cutting blade roller 22 are positioned on the same horizontal axis and tangential to each other, and the bottom blade 211 is recessed in the bottom blade roller 21, while the cutting blade 221 extends out of the cutting blade roller 22; thus, at the time of instantaneously cutting off the gauze, the ends at a cut off portion of the gauze are still clamped by the bottom blade roller 21 and the cutting blade roller 22, so as to avoid the gauze from rebounding in the direction of the traction roller 23 and make it possible to split the gauze continuously and uninterruptedly while forming a tensile force to the gauze.

Preferably, a hollow cavity is set inside the bottom blade roller 21, and the hollow shafts at both ends lead to the hollow cavity, and a centrifugal fan leads to the hollow shaft to make the hollow cavity generate a negative pressure, and leads to a negative pressure hole on the surface of the roller body, avoiding gauze sheets from falling in the process of transferrin them.

Preferably, a first-time inserting blade 212 is set on the bottom blade roller 21, used to insert the crease of the front end of the gauze sheet into the folding-clamping seam 11 on the big rotary drum 1, and co-operationally enable the gauze sheet to be folded for the first time.

In a preferred design, the inserting-folding mechanism 3 includes a second-time inserting roller 31, a pressure roller 32 and a middle inserting roller 33, wherein the second-time inserting roller 31 and the pressure roller 32 are respectively positioned at the upper and lower sides of the horizontal centerline of the big rotary drum 1; a second-time inserting blade 311 of the second-time inserting roller 31 and a middle inserting blade 331 of the middle inserting roller 33 correspond to a folding-clamping seam 11 on the big rotary drum 1, and a triple pressure head 321 on the pressure roller 32 is rotationally in contact with the drum wall. During operation, the second-tome inserting blade 311 on the second-time inserting roller 31 is used to insert the rear end of the gauze sheet into the folding-clamping seam 11 on the big rotary drum 1, and co-operationally enable the gauze sheet to be folded for the second time; the pressure roller 32 is used to roll the gauze sheet after folding for the second-time; the middle inserting blade 331 of the middle inserting roller 33 is used to insert the middle part of the gauze sheet into the folding-clamping seam 11 on the big rotary drum 1, and co-operationally enable the gauze sheet to be folded toward the middle.

Preferably, a big gear is further configured to be connected to the hollow shaft 13 outside the wallboard of one side of the mobile track disk 17, and it drives the hollow shaft 13 to rotate.

Preferably, a gear connected to the second-time inserting roller 31, the pressure roller 32 and the middle inserting roller 33 and a gear connected to a negative pressure shaft 41 of the adsorbing-transferring mechanism 4 all mesh with the big gear, a gear connected to a output end of a driving motor meshes with a gear connected to the negative pressure shaft 41.

In a preferred design, the adsorbing-transferring mechanism 4 includes a plurality of adsorption valves 42 that are distributed in a fan-shaped manner on the negative pressure shaft 41 and a hooking-pulling groove 43 arranged between the adsorption valves 42; a plurality of adsorbing-transferring holes 421 arranged on the arc-shaped end face of the adsorption valve 42 lead to the negative pressure shaft 41, and groove holes 422 are arranged on two sides of the adsorbing-transferring hole 421. During operation, the negative pressure shaft 41 leads to a negative pressure fan, and the adsorbing-transferring hole 421 on the adsorption valve 42 leads to the negative pressure shaft 41, forming an adsorption force at the arc-shaped end surface on the adsorption valve 42; the hooking-pulling groove 43 is used to accommodate a hooking-folding plate 62.

In a preferred design, a barium sulfate thread drawing hook 72 is arranged on the upper part of the unwinding mechanism 5, and an edge-folding mechanism 720 is arranged between the barium sulfate thread drawing hook 72 and the heating roller 7; one side or two sides in the axial direction of a transition roller 721 of the edge-folding mechanism 720 are provided with an edge-pressing lever 722 in contact with it, and one side of the transition roller 721 is also provided with a shaping wheel 723; the barium sulfate thread guiding groove 71 is positioned between the shaping wheel 723 and the heating roller 7. During operation, the barium sulfate thread drawing hook 72 arranged om the upper part of the unwinding mechanism 5 is used to draw out the barium sulfate thread in the barium sulfate thread box behind the gauze roll and guide it to the shaping wheel 723 through the barium sulfate thread drawing hook 72 during producing a gauze sheet to which a barium sulfate thread adheres.

Preferably, the edge-folding mechanism 720 is used to fold the edges of the gauze. Its principle is that, when the gauze passes through the transition roller 721, the edge-pressing levers 722 at both ends of the transition roller 721 are used to press the folded edges of both sides of the gauze on the edge of the transition roller 721, so as to form a folded edge.

In a preferred design, the hooking-folding mechanism 6 includes a longitudinal sliding stand 61, a hooking-folding plate 62 and a pushing plate 63 that are connected to the longitudinal sliding stand 61, a horizontal sliding stand 64, and an inserting-folding plate 65 connected to the horizontal sliding stand 64, wherein the hook-folding plate 62 is positioned in a gap between a accommodating groove 66 and a guiding plate 67 and slides therebetween, the pushing plate 63 is positioned in the accommodating groove 66 and slides therein, and the inserting-folding plate 65 passes through a folding-seam opening 660 on the guiding plate 67 and the accommodating groove 66; a buffer 68 positioned on one side of the guiding plate 67 is connected to a sliding plate 69, and the buffer 68 passes through the guiding plate 67 and penetrates into a gap between the accommodating groove 66 and the guiding plate 67. During operation, the longitudinal sliding stand 61 drives the hooking-folding plate 62 and the pushing plate 63 to move back and forth in a longitudinal direction, while the horizontal sliding stand 64 pushes the inserting-folding plate 65 to move back and forth in a horizontal direction, and the hooking-folding plate 62 and the inserting-folding plate 65 cross each other perpendicularly; the hooking-folding plate 62 hooks and folds radially the gauze folded into strips, and the inserting-folding plate 65 inserts and folds radially the hooked and folded gauze again.

Preferably, when the adsorption valve 42 reaches the hooking-folding mechanism 6, the hooking-folding plate 62 is positioned inside the hooking-pulling groove 43 of the adsorption valve 42; at the same time, when the longitudinal sliding stand 61 drives the hooking-folding plate 62 to move away from the hook pull groove 43, it hooks a gauze strip, and retracts into the gap between the accommodating groove 66 and the guiding plate 67; thus, the gauze strip is folded on both sides of the gap.

Preferably, the sliding plate 69 drives the buffer 68 to pass through the guiding plate 67 and press four folded positions of the gauze strip on the wallboard outside the accommodating groove 66, and the longitudinal sliding stand 61 drives the hooking-folding plate 62 to move away from the hooking-pulling groove 43, while the pushing plate 63 moves away from the end of the accommodating groove 66 synchronously.

Preferably, the sliding plate 69 drives the buffer 68 to move to one side to release the pressure on the folded positions of the gauze strip; at the same time, the horizontal sliding stand 64 drives the inserting-folding plate 65 to pass through the folding seam opening 660 on the guiding plate 67 and the accommodating groove 66; thus, the gauze strip is folded by one-third part from its other end, which coincide with a folded one-third part.

Preferably, while the hooking-folding plate 62 is retracting into the gap between the accommodating groove 66 and the guiding plate 67, the pushing plate 63 synchronously moves back and slides inside the accommodating groove 66, and pushes backwards the folded gauze inside the accommodating groove 6.

Preferably, the sliding plate 69 is connected to a horizontal rod; when the horizontal rod slides back and forth, it drives the sliding plate 69 to move; thus, the sliding plate 69 drives the buffer 68 to act.

In a preferred design, a linkage production method of the compact integrated high-speed folding machine as above-mentioned, comprising the steps of S1 unwinding, the unwinding mechanism 5 releasing a gauze roll, which passes through the edge-folding mechanism 720, the heating roller 7 and the traction roller 23 to reach the splitting mechanism 2 in turn; wherein a misting and moistening device arranged around the unwinding mechanism 5 mists and moistens the gauze released between the heating roller 7 and the unwinding mechanism 5; and if producing gauze with a Barium sulfate thread, releasing a thread, that is, drawing out a barium sulfate thread in a barium sulfate thread box behind the unwinding mechanism 5, enabling it to reach the shaping wheel 723 by way of passing through the barium sulfate thread drawing hook 72 above the gauze then crossing the edge-folding mechanism 720, then to be pressed by a pressing wheel 700 above through the Barium sulfate thread guiding groove 71 and the heating roller 7;

S2 heating, the heating roller 7 heating the gauze in a partitional manner, and controlling temperatures of a subsequent crease area and a barium sulfate thread area on the gauze, respectively; wherein the subsequent crease area folded on the gauze passes through a non-heating section of the heating roller 7, and the barium sulfate thread area and the rest on the gauze are heated through a heating section of the heating roller 7;

S3 splitting, the traction roller 23 clamping the gauze and guiding it to a position between the bottom blade roller 21 and the cutting blade roller 22, the bottom blade roller 21 and the cutting blade roller 22 rotating opposite to each other, and the cutting blade 221 on the cutting blade roller 22 pressing the gauze on the bottom blade 211 of the bottom blade roller 21 and cutting it off, so as to split the gauze into gauze sheets; wherein since the bottom blade 211 is recessed in the bottom blade roller 21, while the cutting blade 221 extends out of the cutting blade roller 22, after cutting off the gauze, ends of the gauze are instantaneously clamped by the bottom blade roller 21 and the cutting blade roller 22, so as to avoid the gauze from rebounding and enable it to be split again;

S4 transferring after first-time inserting, an adsorption hole on the surface of the roller body of the bottom blade roller 21 adsorbing the split-out gauze sheet on the surface of the roller body and the first-time inserting blade 212 on the bottom blade roller 21 supporting the split-out gauze sheet, at the occurrence that the bottom blade roller 21 rotates, the first-time inserting blade 212 inserting the front end of the gauze sheet into the folding-clamping seam 11 of the big rotary drum 1; at the same time, the folding-clamping blade 14 inside the folding-clamping seam 11 clamping the gauze sheet, and after the bottom blade roller 21 continues to rotate, the first-time inserting blade 212 moving away from the folding-clamping seam 11; wherein the front end of the gauze sheet is folded by one-fourth;

S5 pressing after second-time inserting, at the occurrence that the big rotary drum 1 drives the gauze sheet to reach the second-time inserting roller 31, the second-time inserting roller 31 rotating and driving the second-time inserting blade 311 to insert the rear end of the gauze sheet into the folding-clamping seam 11 of the big rotary drum 1; at the same time, the folding-clamping blade 14 inside the folding-clamping seam 11 clamping the gauze sheet, the shifting fork lever 15 before the second-time inserting blade 311 turning over backwards to press the folded part of the front end of the gauze sheet; at the occurrence that the second-time inserting blade 311 moves away from the folding-clamping seam 11 after the second-time inserting roller 31 continues to rotate, the shifting fork lever 15 behind the second-time inserting blade 311 turning over backwards to press the folded part of the rear end of the gauze sheet; wherein the rear end of the gauze sheet is folded by one fourth, the folded parts of both ends of the gauze are all pressed, and two ends of the folded gauze sheet correspond to each other, the area located between the two ends is an area of folding toward the middle;

S6 rolling midway, at the occurrence that the big rotary drum 1 drives the gauze sheet to reach the pressure roller 32, the pressure roller 32 rotating and driving the triple pressure head 321 to roll the pressed gauze sheet; wherein two shifting fork levers 15 pressing the gauze sheet are positioned in the spaces on two sides of the middle head of the triple press head 321;

S7 middle inserting against bursting, at the occurrence that the big rotary drum 1 drives the gauze sheet to reach the second-time inserting roller 31, loosening the folding-clamping blade 14 clamping the positions of the gauze sheet folded for the first time and the second time, the middle inserting roller 33 rotating and driving the middle inserting blade 331 to insert the middle part of the gauze sheet into the folding-clamping seam 11 of the big rotary drum 1, enabling the folding-clamping blade 14 inside the folding-clamping seam 11 to clamp the gauze sheet, and arranging adsorption holes 12 on both sides of the folding-clamping seam 11; at the same time, two shifting fork levers 15 that press the gauze sheet turning over opposite to each other, releasing the portions of the gauze sheet folded for the first time and the second time; wherein the gauze sheet is folded toward the middle, and an adsorption force generated from the adsorption holes 12 is exerted to two ends of the gauze sheet, so as to avoid the two ends of the gauze sheet from falling down and bursting due to its self-weight; wherein a first-time shifting fork lever is released firstly while middle inserting, then a second-time shifting fork lever is released after middle inserting;

S8 adsorbing and transferring, at the occurrence that the big rotary drum 1 drives the gauze sheet to reach the adsorbing-transferring mechanism 4, loosening the folding-clamping blade at the position of folding toward the middle, an adsorption force generated from the adsorption valve 42 being larger than adsorption forces from the adsorption holes 12 on both sides of the folding-clamping seam 11, the adsorption valve 42 adsorbing the gauze sheet, and the adsorbing-transferring mechanism 4 driving the adsorption valve 42 to rotate, so as to transfer the gauze sheet; wherein the gauze sheet folded 3 times forms a gauze strip, of which the length direction is same as the direction of the negative pressure shaft 41 of the adsorbing-transferring mechanism 4;

S9 folding for the fourth time, at the occurrence that the adsorption valve 42 reaches the hooking-folding mechanism 6, enabling the hooking-folding plate 62 to be positioned in the hooking-pulling groove 43 of the adsorption valve 42, at the same time, at the occurrence that the longitudinal sliding stand 61 drives the hooking-folding plate 62 to move away from the hooking-pulling groove 43, the hooking-folding plate 62 hooking the gauze strip and retracting into the gap between the accommodating groove 66 and the guiding plate 67, enabling two sides of the gap to fold the gauze strip; wherein the gauze strip is folded by one-third from one end;

S10 pressing, the sliding plate 69 driving the buffer 68 through the guiding plate 67, so as to press four folded positions of the gauze strip on the wallboard outside the accommodating groove 66, and the longitudinal sliding stand 61 driving the hooking-folding plate 62 to move away from the hooking-pulling groove 43, enabling the pushing plate 63 to move away the end of the accommodating groove 66 synchronously together with the longitudinal sliding stand 61;

S11 folding for the fifth time, the sliding plate 69 driving the buffer 68 to move toward one side, so as to release the pressure on the fold positions of the gauze strip; at the same time, the horizontal sliding stand 64 driving the inserting-folding plate 65 to pass through the folding-seam opening 660 on the guiding plate 67 and the accommodating groove 66 to fold the gauze strip from the other end by one-third, and enabling the part to coincide with the folded one-third part; wherein the folding gauze is located in the accommodating groove 66 and the horizontal sliding stand 64 drives the inserting-folding plate 65 to move away from the folding-seam opening 660; and S12 accommodating, in the process that the hooking-folding plate 62 retracts into the gap between the accommodating groove 66 and the guiding plate 67, the pushing plate 63 synchronously retracting and sliding inside the accommodating groove 66, pushing the folded gauze inside the accommodating groove 66 backwards.

The above-mentioned method can not only produce a gauze sheet with and without a barium sulfate thread on an identical machine, but also synchronously produce either of both gauze sheets or the both gauze sheets; in addition, in the case of producing the gauze sheet with a barium sulfate thread, no waste of barium sulfate threads will occur.

The above embodiments are only preferred technical solutions of the present disclosure, and should not be regarded as limiting the present disclosure. The embodiments in the present application and the features in the embodiments can be arbitrarily combined with each other without conflict. The scope of protection of the present disclosure shall be the technical solutions recorded in the claims, including the equivalent alternatives of the technical features in the technical solutions recorded in the claims. Equivalent substitutions and improvements in the scope are also included in the scope of protection of the present disclosure.

What is claimed is:

1. A compact integrated high-speed folding machine, comprising a big rotary drum (1), a splitting mechanism (2), an inserting-folding mechanism (3), an adsorbing-transferring mechanism (4), an unwinding mechanism (5) and a hooking-folding mechanism (6); wherein a bottom blade roller (21) of the splitting mechanism (2) and a middle inserting roller (33) of the inserting-folding mechanism 3) are respectively positioned at the upper and lower ends of the vertical center line of the big rotary drum (1), the adsorbing-transferring mechanism (4) and the unwinding mechanism (5) are respectively positioned on both sides of the vertical center line, and the hooking-folding mechanism (6) is arranged on one side of the adsorbing-transferring mechanism (4); the splitting mechanism (2) is splitting a gauze sheet, while adsorbing, drawing and transferring another gauze sheet.

2. The compact integrated high-speed folding machine according to claim 1, wherein a heating roller (7) is further arranged between the unwinding mechanism (5) and the splitting mechanism (2), and a Barium sulfate thread guiding groove (71) is arranged in the front of the heating roller (7); the heating roller (7) has a segmented beating structure.

3. The compact integrated high-speed folding machine according to claim 1, wherein folding-clamping seams (11) are disposed on a drum wall of the rotary drum (1), adsorption holes (12) arranged on both sides of one folding-clamping seam (11) between every two folding-clamping seams (11) lead to a negative pressure cavity (110) of the rotary drum (1), and a through hole (131) arranged on a hollow shaft (13) that passes through a drum body of the rotary drum leads to the negative pressure cavity (110); a folding-clamping blade (14) of a folding-clamping mechanism (140) is positioned and configured to swing inside the folding-clamping seam (11), and a shifting fork lever (15) of a shifting fork mechanism (150) is positioned and configured to turn over at the upper part of the folding-clamping seam (11).

4. The compact integrated high-speed folding machine according to claim 3, wherein two ends of the hollow shaft (13) are further respectively matched with a stationary track disk (16) and a mobile track disk (17), and the folding-clamping mechanism (140) and the shifting fork mechanism (150) fit with the stationary track disk (16) and the mobile track disk (17).

5. The compact integrated high-speed folding machine according to claim 1, wherein the splitting mechanism (2) comprises a cutting blade roller (22) matched with the bottom blade roller (21), and a traction roller (23) also arranged at the upper parts of the bottom blade roller (21) and the cutting blade roller (22); a bottom blade (211) and a cutting blade (221) are respectively disposed on the cutting blade roller (22) and the bottom blade roller (21), the bottom blade (211) and the cutting blade (221) hit against each other at a cutting point, and the bottom blade (211) is recessed in the bottom blade roller (21), while the cutting blade (221) extends out of the cutting blade roller (22).

6. The compact integrated high-speed folding machine according to claim 1, wherein the inserting-folding mechanism (3) comprises a second-time inserting roller (31), a pressure roller (32) and a middle inserting roller (33), the second-time inserting roller (31) and the pressure roller (32) are respectively positioned at the upper and lower sides of the horizontal centerline of the rotary drum (1); a second-time inserting blade (311) of the second-time inserting roller (31) and a middle inserting blade (331) of the middle inserting roller (33) correspond to a folding-clamping seam (11) on the rotary drum (1), and a triple pressure head (321) on the pressure roller (32) is rotationally in contact with a drum wall.

7. The compact integrated high-speed folding machine according to claim 1, wherein the adsorbing-transferring mechanism (4) comprises a plurality of adsorption valves (42) that are distributed in a fan-shaped manner on a negative pressure shaft (41) and a hooking-pulling groove (43) arranged between the adsorption valves (42); a plurality of adsorbing-transferring holes (421) arranged on the arc-shaped end face of the adsorption valve (42) lead to the negative pressure shaft (41), and groove holes (422) are arranged on two sides of the adsorbing-transferring hole (421).

8. The compact integrated high-speed folding machine according to claim 2, wherein a barium sulfate thread drawing hook (72) is arranged on the upper part of the unwinding mechanism (5), and an edge-folding mechanism (720) is arranged between the barium sulfate thread drawing hook (72) and the heating roller (7); one side or two sides in the axial direction of a transition roller (721) of the edge-folding mechanism (720) are provided with an edge-pressing lever (722) in contact with it, and one side of the transition roller (721) is further provided with a shaping wheel (723); the barium sulfate thread guiding groove (71) is positioned between the shaping wheel (723) and the heating roller (7).

9. The compact integrated high-speed folding machine according to claim 1, wherein the hooking-folding mechanism (6) comprises a longitudinal sliding stand (61), a hooking-folding plate (62) and a pushing plate (63) that are connected to the longitudinal sliding stand (61), a horizontal sliding stand (64), and an inserting-folding plate (65) connected to the horizontal sliding stand (64), the hook-folding plate (62) is positioned in a gap between a accommodating groove (66) and a guiding plate (67) and slides therebetween, the pushing plate (63) is positioned in the accommodating groove (66) and slides therein, and the inserting-folding plate (65) passes through a folding-seam opening (660) on the guiding plate (67) and the accommodating groove (66); a buffer (68) positioned on one side of the guiding plate (67) is connected to a sliding plate (69), and the buffer (68) passes through the guiding plate (67) and penetrates into a gap between the accommodating groove (66) and the guiding plate (67).

10. A linkage production method of the compact integrated high-speed folding machine according to claim 1, comprising the steps of S1 unwinding, the unwinding mechanism (5) releasing a gauze roll, which passes through the edge-folding mechanism (720), the heating roller (7) and the traction roller (23) to reach the splitting mechanism (2) in turn; wherein a misting and moistening device arranged around the unwinding mechanism (5) mists and moistens the gauze released between the heating roller (7) and the unwinding mechanism (5); and if producing gauze with a Barium sulfate thread, releasing a thread, that is, drawing out a barium sulfate thread in a barium sulfate thread box behind the unwinding mechanism(S), enabling it to reach the shaping wheel (723) by way of passing through the barium sulfate thread drawing hook (72) above the gauze then crossing the edge-folding mechanism (720), then to be pressed by a pressing wheel (700) above through the Barium sulfate thread guiding groove (71) and the heating roller (7);

S2 heating, the heating roller (7) heating the gauze in a partitional manner, and controlling temperatures of a subsequent crease area and a barium sulfate thread area on the gauze, respectively; wherein the subsequent crease area folded on the gauze passes through a non-heating section of the heating roller (7), and the barium sulfate thread area and the rest on the gauze are heated through a heating section of the heating roller (7);

S3 splitting, the traction roller (23) clamping the gauze and guiding it to a position between the bottom blade roller (21) and the cutting blade roller (22), the bottom blade roller (21) and the cutting blade roller (22) rotating opposite to each other, and the cutting blade (221) on the cutting blade roller (22) pressing the gauze on the bottom blade (211) of the bottom blade roller (21) and cutting it off, so as to split the gauze into gauze sheets; wherein since the bottom blade (211) is recessed in the bottom blade roller (21), while the cutting blade (221) extends out of the cutting blade roller (22), after cutting off the gauze, ends of the gauze are instantaneously clamped by the bottom blade roller (21) and the cutting blade roller (22), so as to avoid the gauze from rebounding and enable it to be split again;

S4 transferring after first-time inserting, an adsorption hole on the surface of the roller body of the bottom blade roller (21) adsorbing the split-out gauze sheet on the surface of the roller body and the first-time inserting blade (212) on the bottom blade roller (21) supporting the split-out gauze sheet, at the occurrence that the bottom blade roller (21) rotates, the first-time inserting blade (212) inserting the front end of the gauze sheet into the folding-clamping seam (11) of the rotary drum (1); at the same time, the folding-clamping blade (14) inside the folding-clamping seam (11) clamping the gauze sheet, and after the bottom blade roller (21) continues to rotate, the first-time inserting blade (212) moving away from the folding-clamping seam (11); wherein the front end of the gauze sheet is folded by one-fourth;

S5 pressing after second-time inserting, at the occurrence that the rotary drum (1) drives the gauze sheet to reach the second-time inserting roller (31), the second-time inserting roller (31) rotating and driving the second-time inserting blade (311) to insert the rear end of the gauze sheet into the folding-clamping seam (11) of the rotary drum (1); at the same time, the folding-clamping blade (14) inside the folding-clamping seam (11) clamping the gauze sheet, the shifting fork lever (15) before the second-time inserting blade (311) turning over backwards to press the folded part of the front end of the gauze sheet; at the occurrence that the second-time inserting blade (311) moves away from the folding-clamping seam (11) after the second-time inserting roller (31) continues to rotate, the shifting fork lever (15) behind the second-time inserting blade (311) turning over backwards to press the folded part of the rear end of the gauze sheet; wherein the rear end of the gauze sheet is folded by one fourth, the folded parts of both ends of the gauze are all pressed, and two ends of the folded gauze sheet correspond to each other, the area located between the two ends is an area of folding toward the middle;

S6 rolling midway, at the occurrence that the rotary drum (1) drives the gauze sheet to reach the pressure roller (32), the pressure roller (32) rotating and driving the triple pressure head (321) to roll the pressed gauze sheet; wherein two shifting fork levers (15) pressing the gauze sheet are positioned in the spaces on two sides of the middle head of the triple press head (321);

S7 middle inserting against bursting, at the occurrence that the rotary drum (1) drives the gauze sheet to reach the second-time inserting roller (31), loosening the folding-clamping blade (14) clamping the positions of the gauze sheet folded for the first time and the second time, the middle inserting roller (33) rotating and driving the middle inserting blade (331) to insert the middle part of the gauze sheet into the folding-clamping seam (11) of the rotary drum (1), enabling the folding-clamping blade (14) inside the folding-clamping seam (11) to clamp the gauze sheet, and arranging adsorption holes (12) on both sides of the folding-clamping seam (11); at the same time, two shifting fork levers (15) that press the gauze sheet turning over opposite to each other, releasing the portions of the gauze sheet folded for the first time and the second time; wherein the gauze sheet is folded toward the middle, and an adsorption force generated from the adsorption holes (12) is exerted to two ends of the gauze sheet, so as to avoid the two ends of the gauze sheet from falling down and bursting due to its self-weight; wherein a first-time shifting fork lever is released firstly while middle inserting, then a second-time shifting fork lever is released after middle inserting;

S8 adsorbing and transferring, at the occurrence that the rotary drum (1) drives the gauze sheet to reach the adsorbing-transferring mechanism (4), loosening the folding-clamping blade at the position of folding toward the middle, an adsorption force generated from the adsorption valve (42) being larger than adsorption forces from the adsorption holes (12) on both sides of the folding-clamping seam (11), the adsorption valve (42) adsorbing the gauze sheet, and the adsorbing-transferring mechanism (4) driving the adsorption valve (42) to rotate, so as to transfer the gauze sheet; wherein the gauze sheet folded 3 times forms a gauze strip, of which the length direction is same as the direction of the negative pressure shaft (41) of the adsorbing-transferring mechanism (4);

S9 folding for the fourth time, at the occurrence that the adsorption valve (42) reaches the hooking-folding mechanism (6), enabling the hooking-folding plate (62) to be positioned in the hooking-pulling groove (43) of the adsorption valve (42), at the same time, at the occurrence that the longitudinal sliding stand (61) drives the hooking-folding plate (62) to move away from the hooking-pulling groove (43), the hooking-folding plate (62) hooking the gauze strip and retracting into the gap between the accommodating groove (66) and the guiding plate (67), enabling two sides of the gap to fold the gauze strip, wherein the gauze strip is folded by one-third from one end;

S10 pressing, the sliding plate (69) driving the buffer (68) through the guiding plate (67), so as to press four folded positions of the gauze strip on the wallboard outside the accommodating groove (66), and the longitudinal sliding stand (61) driving the hooking-folding plate (62) to move away from the hooking-pulling groove (43), enabling the pushing plate (63) to move away the end of the accommodating groove (66) synchronously together with the longitudinal sliding stand (61);

S11 folding for the fifth time, the sliding plate (69) driving the buffer (68) to move toward one side, so as to release the pressure on the fold positions of the gauze strip; at the same time, the horizontal sliding stand (64) driving the inserting-folding plate (65) to pass through the folding-seam opening (660) on the guiding plate (67) and the accommodating groove (66) to fold the gauze strip from the other end by one-third, and enabling the part to coincide with the folded one-third part; wherein the folding gauze is located in the accommodating groove (66) and the horizontal sliding stand (64) drives the inserting-folding plate (65) to move away from the folding-seam opening (660); and S12 accommodating, in the process that the hooking-folding plate (62) retracts into the gap between the accommodating groove (66) and the guiding plate (67), the pushing plate (63) synchronously retracting and sliding inside the accommodating groove (66), pushing the folded gauze inside the accommodating groove (66) backwards.

11. The method of claim 10, wherein a heating roller (7) is further arranged between the unwinding mechanism (5) and the splitting mechanism (2), and a Barium sulfate thread guiding groove (71) is arranged in the front of the heating roller (7); the heating roller (7) has a segmented heating structure.

12. The method of claim 10, wherein folding-clamping seams (11) are disposed on a drum wall of the rotary drum (1), adsorption holes (12) arranged on both sides of one folding-clamping seam (11) between every two folding-clamping seams (11) lead to a negative pressure cavity (110) of the rotary drum (1), and a through hole (131) arranged on a hollow shaft (13) that passes through the drum body leads to the negative pressure cavity (110); a folding-clamping blade (14) of the folding-clamping mechanism (140) is positioned and configured to swing inside the folding-clamping seam (11), and a shifting fork lever (15) of a shifting fork mechanism (150) is positioned and configured to turn over at the upper part of the folding-clamping seam (11).

13. The method of claim 12, wherein two ends of the hollow shaft (13) are further respectively matched with a stationary track disk (16) and a mobile track disk (17), and the folding-clamping mechanism (140) and the shifting fork mechanism (150) fit with the stationary track disk (16) and the mobile track disk (17).

14. The method of claim 10, wherein the splitting mechanism (2) comprises a cutting blade roller (22) matched with the bottom blade roller (21), and a traction roller (23) also arranged at the upper parts of the bottom blade roller (21) and the cutting blade roller (22); a bottom blade (211) and a cutting blade (221) are respectively disposed on the cutting blade roller (22) and the bottom blade roller (21), the bottom blade (211) and the cutting blade (221) hit against each other at a cutting point, and the bottom blade (211) is recessed in the bottom blade roller (21), while the cutting blade (221) extends out of the cutting blade roller (22).

15. The method of claim 10, wherein the inserting-folding mechanism (3) comprises a second-time inserting roller (31), a pressure roller (32) and a middle inserting roller (33), the second-time inserting roller (31) and the pressure roller (32) are respectively positioned at the upper and lower sides of the horizontal centerline of the rotary drum (1); a second-time inserting blade (311) of the second-time inserting roller (31) and a middle inserting blade (331) of the middle inserting roller (33) correspond to a folding-clamping seam (11) on the rotary drum (1), and a triple pressure head (321) on the pressure roller (32) is rotationally in contact with a drum wall.

16. The method of claim 10, wherein the adsorbing-transferring mechanism (4) comprises a plurality of adsorption valves (42) that are distributed in a fan-shaped manner on a negative pressure shaft (41) and a hooking-pulling groove (43) arranged between the adsorption valves (42); a plurality of adsorbing-transferring holes (421) arranged on the arc-shaped end face of the adsorption valve (42) lead to the negative pressure shaft (41), and groove holes (422) are arranged on two sides of the adsorbing-transferring hole (421).

17. The method of claim 11, wherein a barium sulfate thread drawing hook (72) is arranged on the upper part of the unwinding mechanism (5), and an edge-folding mechanism (720) is arranged between the barium sulfate thread drawing hook (72) and the heating roller (7); one side or two sides in the axial direction of a transition roller (721) of the edge-folding mechanism (720) are provided with an edge-pressing lever (722) in contact with it, and one side of the transition roller (721) is further provided with a shaping wheel (723); the barium sulfate thread guiding groove (71) is positioned between the shaping wheel (723) and the heating roller (7).

18. The method of claim 10, wherein the hooking-folding mechanism (6) comprises a longitudinal sliding stand (61), a hooking-folding plate (62) and a pushing plate (63) that are connected to the longitudinal sliding stand (61), a horizontal sliding stand (64), and an inserting-folding plate (65) connected to the horizontal sliding stand (64), the hook-folding plate (62) is positioned in a gap between a accommodating groove (66) and a guiding plate (67) and slides therebetween, the pushing plate (63) is positioned in the accommodating groove (66) and slides therein, and the inserting-folding plate (65) passes through a folding-seam opening (660) on the guiding plate (67) and the accommodating groove (66); a buffer (68) positioned on one side of the guiding plate (67) is connected to a sliding plate (69), and the buffer (68) passes through the guiding plate (67) and penetrates into a gap between the accommodating groove (66) and the guiding plate (67).

* * * * *